US007794565B2

(12) United States Patent
Shannon et al.

(10) Patent No.: US 7,794,565 B2
(45) Date of Patent: Sep. 14, 2010

(54) METHOD OF MAKING LOW SLOUGH TISSUE PRODUCTS

(75) Inventors: Thomas Gerard Shannon, Neenah, WI (US); Kelly Dean Branham, Woodstock, GA (US); William Clayton Bunyard, DePere, WI (US); Lisa Ann Flugge-Berendes, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 27 days.

(21) Appl. No.: 12/080,683

(22) Filed: Apr. 4, 2008

(65) Prior Publication Data

US 2008/0185114 A1 Aug. 7, 2008

Related U.S. Application Data

(62) Division of application No. 10/289,558, filed on Nov. 6, 2002, now abandoned.

(51) Int. Cl.
*D21H 17/37* (2006.01)
*D21H 17/45* (2006.01)
*D21H 21/14* (2006.01)

(52) U.S. Cl. ..... 162/168.2; 162/158; 162/164.1; 162/168.1; 162/184; 526/310; 526/319; 526/320

(58) Field of Classification Search ..... 162/158, 162/164.1, 168.1, 168.2, 184; 526/310, 319, 526/320
See application file for complete search history.

(56) References Cited

U.S. PATENT DOCUMENTS 3,434,918 A * 3/1969 Bernardin ..... 162/111
3,556,932 A 1/1971 Coscia et al.
3,556,933 A 1/1971 Williams et al.
3,695,269 A 10/1972 Malaney
3,700,623 A 10/1972 Keim
3,772,076 A 11/1973 Keim
3,838,692 A 10/1974 Levesque
3,855,158 A 12/1974 Petrovich et al.
3,879,257 A 4/1975 Gentile et al.
3,899,387 A 8/1975 Freis et al.
3,899,388 A 8/1975 Petrovich et al.
4,100,324 A 7/1978 Anderson et al.
4,129,528 A 12/1978 Petrovich et al.
4,147,586 A 4/1979 Petrovich et al.
4,147,681 A 4/1979 Lim et al.
4,162,190 A 7/1979 Ashworth
4,222,921 A 9/1980 Van Eenam
4,287,251 A 9/1981 King et al.
4,297,860 A 11/1981 Pacifici et al.
4,308,092 A 12/1981 Latimer et al.
4,326,000 A 4/1982 Roberts, Jr.
4,377,615 A 3/1983 Suzuki et al.
4,406,737 A 9/1983 Latimer et al.
4,408,996 A 10/1983 Baldwin
4,414,268 A 11/1983 Baldwin
4,425,186 A 1/1984 May et al.
4,425,372 A 1/1984 Baldwin
4,426,418 A 1/1984 Coleman et al.
4,432,833 A 2/1984 Breese
4,440,597 A 4/1984 Wells et al.
4,514,345 A 4/1985 Johnson et al.
4,528,239 A 7/1985 Trokhan
4,529,480 A 7/1985 Trokhan
4,537,822 A 8/1985 Nanri et al.
4,551,199 A 11/1985 Weldon
4,556,450 A 12/1985 Chuang et al.
4,559,162 A 12/1985 Abel et al.
4,588,457 A 5/1986 Crenshaw et al.
4,605,702 A 8/1986 Guerro et al.
4,610,915 A 9/1986 Crenshaw et al.
4,773,110 A 9/1988 Hopkins (Continued)

FOREIGN PATENT DOCUMENTS

CA 2059627 7/1992

(Continued)

OTHER PUBLICATIONS

Kendhale, Amol et al., "Isotactic *N*-alkyl Acrylamide Oligomers Assume Self-Assembled Sheet Structure: First Unequivocal Evidence From Crystal Structures," *Chemical Communications,* 2006, pp. 2756-2758.

(Continued)

*Primary Examiner*—Eric Hug
*Assistant Examiner*—Dennis Cordray
(74) *Attorney, Agent, or Firm*—Gregory E. Croft

(57) ABSTRACT

The present invention is a soft tissue sheet having reduced lint and slough. The tissue sheet comprises papermaking fibers and a synthetic co-copolymer. The synthetic co-polymer has the general structure:

wherein $R^1$, $R^2$, $R^3$ are independently selected from a group consisting of: H; $C_{1-4}$ alkyl radicals; and, mixtures thereof; $R^4$ is selected from a group consisting of $C_1$-$C_8$ alkyl radicals and mixtures thereof; $Z^1$ is a bridging radical attaching the $R^4$ functionality to the polymer backbone; and, $Q^1$ is a functional group containing at least a cationic quaternary ammonium radical. w, x, y≧1 and the mole ratio of x to (x+y) is about 0.5 or greater.

27 Claims, 4 Drawing Sheets

U.S. PATENT DOCUMENTS

| | | | | |
|---|---|---|---|---|
| 4,816,320 | A | 3/1989 | St. Cyr | |
| 4,886,632 | A | 12/1989 | Van Iten et al. | |
| 4,894,054 | A | 1/1990 | Miskinyar | |
| 4,905,545 | A | 3/1990 | Leising et al. | |
| 4,919,877 | A | 4/1990 | Parsons et al. | |
| 4,925,528 | A | 5/1990 | Tse et al. | |
| 4,950,545 | A | 8/1990 | Walter et al. | |
| 5,059,282 | A | 10/1991 | Ampulski et al. | |
| 5,098,522 | A | 3/1992 | Smurkoski et al. | |
| 5,164,046 | A | 11/1992 | Ampulski et al. | |
| 5,167,766 | A | 12/1992 | Honig et al. | |
| 5,178,729 | A | 1/1993 | Janda | |
| 5,215,626 | A | 6/1993 | Ampulski et al. | |
| 5,215,629 | A | 6/1993 | Skatulla et al. | |
| 5,217,576 | A * | 6/1993 | Van Phan | 162/158 |
| 5,227,242 | A | 7/1993 | Walter et al. | |
| 5,230,776 | A | 7/1993 | Andersson et al. | |
| 5,234,547 | A | 8/1993 | Knight et al. | |
| 5,246,545 | A | 9/1993 | Ampulski et al. | |
| 5,246,546 | A | 9/1993 | Ampulski | |
| 5,260,171 | A | 11/1993 | Smurkoski et al. | |
| 5,275,700 | A | 1/1994 | Trokhan | |
| 5,277,242 | A | 1/1994 | Arrington | |
| 5,328,565 | A | 7/1994 | Rasch et al. | |
| 5,334,289 | A | 8/1994 | Trokhan et al. | |
| 5,353,521 | A | 10/1994 | Orloff | |
| 5,385,643 | A | 1/1995 | Ampulski | |
| 5,389,204 | A | 2/1995 | Ampulski | |
| 5,399,412 | A | 3/1995 | Sudall et al. | |
| 5,431,786 | A | 7/1995 | Rasch et al. | |
| 5,494,554 | A | 2/1996 | Edwards et al. | |
| 5,496,624 | A | 3/1996 | Stelljes, Jr. et al. | |
| 5,500,277 | A | 3/1996 | Trokhan et al. | |
| 5,503,715 | A | 4/1996 | Trokhan et al. | |
| 5,514,523 | A | 5/1996 | Trokhan et al. | |
| 5,525,345 | A | 6/1996 | Warner et al. | |
| 5,529,665 | A | 6/1996 | Kaun | |
| 5,538,595 | A | 7/1996 | Trokhan et al. | |
| 5,552,020 | A | 9/1996 | Smith et al. | |
| 5,554,467 | A | 9/1996 | Trokhan et al. | |
| 5,558,873 | A | 9/1996 | Funk et al. | |
| 5,566,724 | A | 10/1996 | Trokhan et al. | |
| 5,573,637 | A | 11/1996 | Ampulski et al. | |
| 5,591,306 | A | 1/1997 | Kaun | |
| 5,598,642 | A | 2/1997 | Orloff et al. | |
| 5,598,643 | A | 2/1997 | Chuang et al. | |
| 5,607,980 | A | 3/1997 | McAtee et al. | |
| 5,614,293 | A | 3/1997 | Krzysik et al. | |
| 5,624,790 | A | 4/1997 | Trokhan et al. | |
| 5,628,876 | A | 5/1997 | Ayers et al. | |
| 5,635,191 | A | 6/1997 | Roe et al. | |
| 5,637,194 | A | 6/1997 | Ampulski et al. | |
| 5,638,876 | A | 6/1997 | Shimotoyodome et al. | |
| 5,643,588 | A | 7/1997 | Roe et al. | |
| 5,650,218 | A | 7/1997 | Krzysik et al. | |
| 5,656,132 | A | 8/1997 | Farrington, Jr. et al. | |
| 5,679,218 | A | 10/1997 | Vinson et al. | |
| 5,695,607 | A | 12/1997 | Oriaran et al. | |
| 5,699,626 | A | 12/1997 | Chuang et al. | |
| 5,701,682 | A | 12/1997 | Chuang et al. | |
| 5,725,736 | A | 3/1998 | Schroeder et al. | |
| 5,763,044 | A | 6/1998 | Ahr et al. | |
| 5,772,845 | A | 6/1998 | Farrington, Jr. et al. | |
| 5,785,813 | A | 7/1998 | Smith et al. | |
| 5,830,317 | A | 11/1998 | Vinson et al. | |
| 5,830,321 | A | 11/1998 | Lindsay et al. | |
| 5,846,380 | A | 12/1998 | Van Phan et al. | |
| 5,849,447 | A | 12/1998 | Matsuda | |
| 5,855,739 | A | 1/1999 | Ampulski et al. | |
| 5,871,763 | A | 2/1999 | Luu et al. | |
| 5,885,416 | A | 3/1999 | Marinack et al. | |
| 5,885,418 | A | 3/1999 | Anderson et al. | |
| 5,893,965 | A | 4/1999 | Trokhan et al. | |
| 5,897,745 | A | 4/1999 | Ampulski et al. | |
| 5,932,068 | A | 8/1999 | Farrington, Jr. et al. | |
| 5,935,381 | A | 8/1999 | Trokhan et al. | |
| 5,954,921 | A | 9/1999 | Dahmen et al. | |
| 5,968,853 | A | 10/1999 | Kelly et al. | |
| 5,972,813 | A | 10/1999 | Polat et al. | |
| 5,981,044 | A | 11/1999 | Phan et al. | |
| 5,990,377 | A | 11/1999 | Chen et al. | |
| 6,010,598 | A | 1/2000 | Boutilier et al. | |
| 6,017,417 | A | 1/2000 | Wendt et al. | |
| 6,027,611 | A | 2/2000 | McFarland et al. | |
| D421,528 | S | 3/2000 | Shakora | |
| 6,054,020 | A | 4/2000 | Goulet et al. | |
| 6,080,686 | A | 6/2000 | Floyd | |
| 6,083,348 | A | 7/2000 | Auhorn et al. | |
| 6,096,169 | A | 8/2000 | Hermans et al. | |
| 6,103,060 | A | 8/2000 | Munerelle et al. | |
| 6,103,063 | A | 8/2000 | Oriaran et al. | |
| 6,132,803 | A | 10/2000 | Kelly et al. | |
| 6,143,135 | A | 11/2000 | Hada et al. | |
| 6,149,768 | A | 11/2000 | Hepford | |
| 6,149,769 | A | 11/2000 | Mohammadi et al. | |
| 6,162,327 | A | 12/2000 | Batra et al. | |
| 6,179,961 | B1 | 1/2001 | Ficke et al. | |
| 6,197,154 | B1 | 3/2001 | Chen et al. | |
| 6,224,714 | B1 | 5/2001 | Schroeder et al. | |
| 6,231,719 | B1 | 5/2001 | Garvey et al. | |
| 6,274,667 | B1 | 8/2001 | Shannon et al. | |
| 6,287,418 | B1 | 9/2001 | Schroeder et al. | |
| 6,315,866 | B1 | 11/2001 | Sanchez | |
| 6,319,365 | B1 | 11/2001 | Inoue | |
| 6,332,952 | B1 | 12/2001 | Hsu et al. | |
| 6,365,667 | B1 | 4/2002 | Shannon et al. | |
| 6,379,498 | B1 | 4/2002 | Burns et al. | |
| 6,395,957 | B1 | 5/2002 | Chen et al. | |
| 6,423,183 | B1 | 7/2002 | Goulet et al. | |
| 6,432,268 | B1 | 8/2002 | Burghardt | |
| 6,432,270 | B1 | 8/2002 | Liu et al. | |
| 6,458,243 | B1 | 10/2002 | Jones et al. | |
| 6,488,812 | B2 | 12/2002 | Shannon et al. | |
| 6,511,580 | B1 | 1/2003 | Liu | |
| 6,514,383 | B1 | 2/2003 | Liu et al. | |
| 6,582,560 | B2 | 6/2003 | Runge et al. | |
| 6,828,014 | B2 | 12/2004 | Branham et al. | |
| 6,951,598 | B2 | 10/2005 | Flugge et al. | |
| 6,960,371 | B2 * | 11/2005 | Bunyard et al. | 427/342 |
| 6,964,725 | B2 | 11/2005 | Shannon et al. | |
| 6,994,865 | B2 * | 2/2006 | Branham et al. | 424/402 |
| 7,008,507 | B2 | 3/2006 | Urlaub et al. | |
| 7,029,756 | B2 | 4/2006 | Moline et al. | |
| 7,101,456 | B2 * | 9/2006 | Bunyard et al. | 156/305 |
| 2002/0112834 | A1 | 8/2002 | Shannon et al. | |
| 2002/0112835 | A1 | 8/2002 | Liu et al. | |
| 2002/0139500 | A1 | 10/2002 | Runge et al. | |
| 2002/0162243 | A1 | 11/2002 | Runge et al. | |
| 2003/0022568 | A1 | 1/2003 | Branham et al. | |
| 2003/0026963 | A1 | 2/2003 | Chang et al. | |
| 2003/0027470 | A1 | 2/2003 | Chang et al. | |
| 2003/0032352 | A1 | 2/2003 | Chang et al. | |
| 2003/0045645 | A1 | 3/2003 | Chang et al. | |
| 2003/0055146 | A1 | 3/2003 | Chang et al. | |
| 2003/0056916 | A1 | 3/2003 | Horenziak et al. | |
| 2003/0077314 | A1 | 4/2003 | Shannon et al. | |
| 2004/0074622 | A1 | 4/2004 | Liu et al. | |
| 2004/0084162 | A1 | 5/2004 | Shannon et al. | |
| 2004/0084164 | A1 | 5/2004 | Shannon et al. | |
| 2004/0086727 | A1 | 5/2004 | Flugge et al. | |
| 2004/0099392 | A1 | 5/2004 | Liu et al. | |
| 2004/0118532 | A1 | 6/2004 | Sarbo et al. | |
| 2004/0118533 | A1 | 6/2004 | Shannon et al. | |
| 2004/0144507 | A1 | 7/2004 | Shannon et al. | |

2004/0234804 A1 11/2004 Liu et al.

FOREIGN PATENT DOCUMENTS

| | | | |
|---|---|---|---|
| EP | 0 347 153 | A2 | 12/1989 |
| EP | 0 347 154 | A2 | 12/1989 |
| EP | 0 350 277 | A2 | 1/1990 |
| EP | 0 497 100 | A2 | 8/1992 |
| EP | 0 347 177 | B1 | 5/1995 |
| EP | 0 643 083 | B1 | 5/1997 |
| EP | 0 347 176 | B2 | 7/1997 |
| EP | 1 013 823 | A1 | 6/2000 |
| EP | 0 708 860 | B1 | 11/2000 |
| EP | 1 258 561 | A2 | 11/2002 |
| FR | 2715052 | A1 | 7/1995 |
| GB | 1 372 787 | A | 11/1974 |
| JP | 03-266367 | B | 11/1991 |
| JP | 06-270361 | A | 9/1994 |
| WO | WO 98/40425 | A1 | 9/1998 |
| WO | WO 99/05358 | A1 | 2/1999 |
| WO | WO 99/55962 | A2 | 11/1999 |
| WO | WO 00/04233 | A1 | 1/2000 |
| WO | WO 00/77303 | A1 | 12/2000 |
| WO | WO 01/04416 | A1 | 1/2001 |
| WO | WO 01/14631 | A1 | 3/2001 |
| WO | WO 01/29312 | A1 | 4/2001 |
| WO | WO 01/49937 | A1 | 7/2001 |
| WO | WO 02/14606 | A2 | 2/2002 |
| WO | WO 02/44470 | A1 | 6/2002 |
| WO | WO 02/48457 | A2 | 6/2002 |
| WO | WO 02/072951 | A2 | 9/2002 |
| WO | WO 02/077042 | A2 | 10/2002 |
| WO | WO 03/021037 | A1 | 3/2003 |
| WO | WO 03/037394 | A1 | 5/2003 |

OTHER PUBLICATIONS

Sánchez, María C. et al., "High-Resolution NMR Studies of Methyl Acrylate Adsorbed On Silica and $TiCl_4$-Modified Silica," *Journal of the Chemical Society—Faraday Transactions,* vol. 93, No. 10, 1997, pp. 1981-1985.

Sivagurunathan, P. et al., "Solvent Effects on Hydrogen Bonding Between Ethanol and Acrylic Esters," *Zeitschrift für Physikalische Chemie,* vol. 221, No. 2, 2007, pp. 273-280.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

TAPPI Provisional Method T 530 pm-89, "Size Test for Paper By Ink Resistance (Hercules Method)," published by the TAPPI Press, Atlanta, Georgia, revised 1989, pp. 1-5.

Foulger, M. et al., "New Technology to Apply Starch and Other Additives," *Pulp & Paper Canada,* vol. 100, No. 2, 1999, pp. 24-25.

Luo, Yingwu and F. Joseph Schork, "Emulsion Copolymerization of Butyl Acrylate With Cationic Monomer Using Interfacial Redox Initiator System," *Journal of Polymer Science: Part A: Polymer Chemistry,* vol. 39, 2001, pp. 2696-2709.

Yan, Zegui et al., "Synthesis and Characterization of Cationic Copolymers of Butylacrylate and [3-(Methacryloylamino)-propyl]trimethylammonium Chloride," *Journal of Polymer Science, Part A: Polymer Chemistry,* vol. 39, 2001, pp. 1031-1039.

* cited by examiner

METHOD OF MAKING LOW SLOUGH TISSUE PRODUCTS

This application is a divisional application of U.S. Ser. No. 10/289,558 filed Nov. 6, 2002 now abandoned. The entirety of U.S. Ser. No. 10/289,558 is hereby incorporated by reference.

BACKGROUND OF THE INVENTION

In the manufacture of paper products, such as facial tissue, bath tissue, paper towels, dinner napkins and the like, a wide variety of product properties are imparted to the final product through the use of chemical additives applied in the wet end of the tissue making process. Two of the most important attributes imparted to tissue through the use of wet end chemical additives are strength and softness. Specifically for softness, a chemical debonding agent is normally used. Such debonding agents are typically quaternary ammonium compounds containing long chain alkyl groups. The cationic quaternary ammonium entity allows for the material to be retained on the cellulose via ionic bonding to anionic groups on the cellulose fibers. The long chain alkyl groups, provide softness to the tissue sheet by disrupting fiber-to-fiber hydrogen bonds in the sheet.

Such disruption of fiber-to-fiber bonds provides a two-fold purpose in increasing the softness of the tissue sheet. First, the reduction in hydrogen bonding produces a reduction in tensile strength thereby reducing the stiffness of the tissue sheet. Secondly, the debonded fibers provide a surface nap to the tissue sheet enhancing the "fuzziness" of the tissue sheet. This tissue sheet fuzziness may also be created through use of creping as well, where sufficient interfiber bonds are broken at the outer tissue surface to provide a plethora of free fiber ends on the tissue surface.

Both debonding and creping increase levels of lint and slough in the product. Indeed, while softness increases, it is at the expense of an increase in lint and slough in the tissue sheet relative to an untreated control. It can also be shown that in a blended (non-layered) tissue sheet that the level of lint and slough is inversely proportional to the tensile strength of the tissue sheet. Lint and slough can generally be defined as the tendency of the fibers in the paper sheet to be rubbed from the sheet when handled.

A multi-layered tissue structure to enhance the softness of the tissue sheet. One such embodiment, a thin layer of strong softwood fibers is used in the center layer to provide the necessary tensile strength for the product. The outer layers of such structures are composed of the shorter hardwood fibers, which may or may not contain a chemical debonder. A disadvantage to using layered structures is that while softness is increased the mechanism for such increase is believed due to an increase in the surface nap of the debonded, shorter fibers. As a consequence, such structures, while showing enhanced softness, do so with a trade-off of an increase in the level of lint and slough.

A chemical strength agent may be added in the wet-end to counteract the negative effects of the debonding agents. In a blended tissue sheet, the addition of such chemical strength agents reduces lint and slough levels. However, such reduction is done at the expense of surface feel and overall softness of the tissue sheet and becomes primarily a function of tissue sheet tensile strength. In a layered tissue sheet, strength chemicals are added preferentially to the center layer. While this perhaps helps to give a tissue sheet with an improved surface feel at a given tensile strength, such structures actually exhibit higher slough and lint at a given tensile strength, with the level of debonder in the outer layer being directly proportional to the increase in lint and slough. Co-pending U.S. patent application Ser. No. 09/736,924 (Shannon et al.) published on Aug. 22, 2002 discloses low slough tissue products made with acrylamides containing hydrophobic moieties. These synthetic polymers, while reducing the amount of slough compared to traditional debonders, still show an increase in slough with decreasing tensile strength.

Therefore there is a need for a means of reducing lint and slough in soft tissue sheets while maintaining the softness and strength of the tissue sheets. It is an objective of the present invention to design paper-making chemicals, more specifically tissue making chemicals, capable of reducing hydrogen bonding while also possessing ability to reduce lint and slough. It is a further objective to develop a process for making soft, low slough, low lint tissue products via wet end application of chemistry. It is a further objective of the present invention to make soft, absorbent, low lint and slough tissue products such as sanitary bath tissue, facial tissue, paper towels and the like via wet end application of such chemistry.

SUMMARY

It has now been discovered that certain cationic water dispersible synthetic co-polymers when applied to the wet end of the tissue machine may act as debonding chemicals while at the same time reducing the amount of lint and slough. Hence, soft tissue sheets having low lint and slough levels are obtained. The chemicals of the present invention are synthetic co-polymers formed from two or more different monomers. The synthetic co-polymers of the present invention are the polymerization product of a cationic monomer and at least one hydrophobic monomer. Additionally, the synthetic co-polymers of the present invention may also be the polymerization product of a cationic monomer, at least one hydrophobic monomer and optionally at least one non-ionic hydrophilic monomer. While not wishing to be bound by theory, it is believed that the synthetic co-polymers attach to the fibers via electrostatic attraction for the anionic fibers. As the synthetic co-polymers have no hydrogen or covalent bonding entity, they debond the fibers via the traditional mechanism by which chemical debonding agents function.

The synthetic co-polymers of the present invention are, however, good film forming agents and have good intermolecular adhesive properties. Hence, the fibers are held in place by the co-polymer to co-polymer cohesive properties and good slough reduction occurs. The aliphatic hydrocarbon portion of the synthetic co-polymer molecule enables a significant level of debonding to occur and insures that the tissue sheet product has good surface nap or "fuzzy" feel. Yet, these fibers retain a significant inter-fiber bonding potential due to intra- and inter-molecular associative forces present in the synthetic co-polymers that help the fibers remain anchored to the tissue sheet. As such, fibers treated with these synthetic co-polymers produce a tissue sheet having lower lint and slough at a given tensile strength than a tissue sheet prepared with conventional softening agents or a combination of conventional softening agents and conventional strength agents.

The term "water dispersible" as used herein, means that the cationic synthetic co-polymers are either water soluble or capable of existing as stable colloidal, self-emulsifiable or other type dispersions in water without the presence of added emulsifiers. Added emulsifiers may be employed within the scope of the present invention to aid in the polymerization of the cationic synthetic co-polymers or assist in compatibilizing the cationic synthetic co-polymers with other chemical agents used in the tissue sheet, however, the emulsifiers are not essential to formation of stable dispersions or solutions of the cationic synthetic co-polymers in water.

It is known in the art to add latex polymer emulsions of styrene butadiene rubber binders and ethylene vinyl acetate binders topically to a formed tissue sheet to decrease strength loss associated with topical application of debonders and other softening agents. Large amounts of emulsifiers are used in the production of such latex polymers and these emulsifiers are critical to the stability of the latex polymers in water. The latex polymers are not of themselves water dispersible. The emulsions are susceptible to breaking, causing a film of the latex polymer to develop on processing equipment. This film continues to deposit on equipment to the point where shutdown and clean-up of the equipment is required. As the latex polymers are not water dispersible clean-up can be time consuming, costly and environmentally unfriendly. Furthermore, the lack of water dispersability makes tissue sheets made with these latex polymers difficult to impossible to redisperse, causing a significant economic penalty to be incurred in tissue sheets employing these traditional latex polymers. As these latex polymers are not cationic, wet end application of these latex polymers is significantly constrained and the latex polymers demonstrate ability to only increase strength. The disadvantages to using these materials have severely limited commercial use of traditional latex polymers in tissue-based products.

It is known wherein a procedure for creping paper comprises incorporation in paper pulp or a paper sheet of a cationic water soluble addition polymer containing amine groups and optionally quaternary ammonium groups. Optionally the addition polymer may contain units of one other monoethylenically unsaturated monomers in a level such that the addition polymer remains water soluble. A critical aspect of such a procedure is the presence of free amine groups which, when used in conjunction with the optional quaternary group, must be present in a ratio>1:1 relative to the quaternary group. The addition polymers are used as creping facilitators to promote enhanced Yankee dryer adhesion. However, enhanced Yankee dryer adhesion is typically not a desirable characteristic when making low slough and lint tissue-based products, such adhesion being known to those skilled in the art to increase levels of lint and slough. Furthermore, the presence of the free amine groups makes the addition polymers sensitive to pH when applied in the wet end of tissue making processes, turning the tissue sheet hydrophobic under acidic conditions and imparting undesired wet strength when used under basic conditions. An additional consideration when using the addition polymers is the presence of the free amine groups, capable of reacting with other papermaking additives, such as those containing aldehyde and azetidinium groups, thereby risking the reduction of the efficacy of those additives.

Hence, in one aspect, the present invention resides in a tissue chemical additive capable of simultaneously debonding and reducing lint and slough, the tissue chemical additive comprising a cationic synthetic water dispersible co-polymer containing a hydrophobic portion such that the hydrophobic portion is capable of demonstrating intra-molecular adhesive properties in the dry state while exhibiting ability to debond a tissue sheet when applied to the tissue sheet at a low consistency. The synthetic co-polymers have the following general structure:

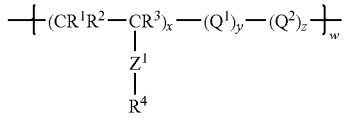

Wherein:

$R^1, R^2, R^3$ are independently H, $C_{1-4}$ alkyl radical, or mixtures thereof.

$R^4$ is a $C_1$-$C_8$ alkyl radical or mixtures thereof.

$Z^1$ is a bridging radical attaching the $R^4$ functionality to the polymer backbone. Examples include, but are not limited to, —O—, —COO—, —OOC—, —CONH—, —NHCO—, and mixtures thereof.

$Q^1$ is a functional group containing a cationic quaternary ammonium radical.

$Q^2$ is an optional group comprised of a non-ionic hydrophilic or water soluble monomer or monomers (and mixtures thereof) incorporated into the synthetic co-polymer so as to make the synthetic co-polymer more hydrophilic. $Q^2$ possesses limited ability to hydrogen or covalently bond to cellulose fibers, such bonding resulting in an increase in stiffness of the tissue sheet. Suitable hydrophilic monomers or water-soluble nonionic monomers for use in the cationic synthetic co-polymers of the present invention include, but are not limited to, monomers, such as, hydroxyalkyl acrylates and hydroxyalkyl methacrylates, such as hydroxyethyl methacrylate (HEMA); hydroxyethyl acrylate; polyalkoxyl acrylates, such as polyethyleneglycol acrylates; and, polyalkoxyl methacrylates, such as polyethyleneglycol methacrylates ("PEG-MA"). Other suitable hydrophilic monomers or water-soluble nonionic monomers for use in the ion-sensitive cationic synthetic co-polymers of the present invention include, but are not limited to, diacetone acrylamide, N-vinylpyrrolidinone, and N-vinylformamide.

The mole ratio of z:x will specifically range from about 0:1 to about 4:1, more specifically from about 0:1 to about 1:1, and most specifically from about 0:1 to about 1:3. The mole ratio of (x+z):y may be from about 0.98:0.02 to about 1:1, and most specifically from about 0.95:0.05 to about 0.70:0.30.

Hence, in another aspect, the present invention resides in a soft, low lint and slough absorbent paper sheet, such as a tissue sheet, comprising a cationic synthetic water dispersible co-polymer containing a hydrophobic portion such that the hydrophobic portion is capable of demonstrating intermolecular associative properties in the dry state while exhibiting ability to debond a tissue sheet when applied to the tissue sheet at a low consistency. The cationic water dispersible synthetic co-polymers have the following general structure:

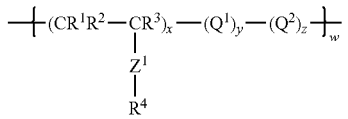

Wherein:

$R^1, R^2, R^3$ are independently H, $C_{1-4}$ alkyl radical, or mixtures thereof.

$R^4$ is a $C_1$-$C_8$ alkyl radical or mixtures thereof.

$Z^1$ is a bridging radical attaching the $R^4$ functionality to the polymer backbone. Examples include, but are not limited to, —O—, —COO—, —OOC—, —CONH—, —NHCO—, and mixtures thereof.

$Q^1$ is a functional group containing a cationic quaternary ammonium radical.

$Q^2$ is an optional group comprised of a non-ionic hydrophilic or water soluble monomer or monomers (and mixtures thereof) incorporated into the synthetic co-polymer so as to make the synthetic co-polymer more hydrophilic. $Q^2$ possesses limited ability to hydrogen or covalently bond to cellulose fibers, such bonding resulting in an increase in stiffness of the tissue sheet. Suitable hydrophilic monomers or water-soluble nonionic monomers for use in the cationic synthetic co-polymers of the present invention include, but are not limited to, monomers, such as, hydroxyalkyl acrylates and hydroxyalkyl methacrylates, such as hydroxyethyl methacrylate (HE MA); hydroxyethyl acrylate; polyalkoxyl acrylates, such as polyethyleneglycol acrylates; and, polyalkoxyl methacrylates, such as polyethyleneglycol methacrylates ("PEG-MA"). Other suitable hydrophilic monomers or water-soluble nonionic monomers for use in the ion-sensitive cationic synthetic co-polymers of the present invention include, but are not limited to, diacetone acrylamide, N-vinylpyrrolidinone, and N-vinylformamide.

The mole ratio of z:x will specifically range from about 0:1 to about 4:1, more specifically from about 0:1 to about 1:1, and most specifically from about 0:1 to about 1:3. The mole ratio of (x+z):y may be from about 0.98:0.02 to about 1:1, and most specifically from about 0.95:0.05 to about 0.70:0.30.

In another aspect, the present invention resides in a method of making a soft, low lint tissue sheet, comprising the steps of: (a) forming an aqueous suspension comprising papermaking fibers; (b) depositing the aqueous suspension of papermaking fibers onto a forming fabric to form a wet tissue sheet; and, (c) dewatering and drying the wet tissue sheet to form a paper sheet, wherein a cationic water dispersible synthetic co-polymer containing a hydrophobic portion such that the hydrophobic portion is capable of demonstrating intra-molecular adhesive properties in the dry state while exhibiting an ability to debond the tissue sheet is added to the aqueous suspension of the papermaking fibers or topically to the wet tissue sheet at a consistency of about 80% or less, the cationic water dispersible synthetic co-polymer has the following general structure:

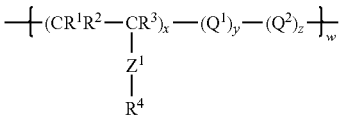

Wherein:

$R^1$, $R^2$, $R^3$ are independently H, $C_{1-4}$ alkyl radical, or mixtures thereof.

$R^4$ is a $C_1$-$C_8$ alkyl radical or mixtures thereof.

$Z^1$ is a bridging radical attaching the $R^4$ functionality to the polymer backbone. Examples include, but are not limited to, —O—, —COO—, —OOC—, —CONH—, —NHCO—, and mixtures thereof.

$Q^1$ is a functional group containing a cationic quaternary ammonium radical.

$Q^2$ is an optional group comprising a non-ionic hydrophilic or water soluble monomer or monomers (and mixtures thereof) incorporated into the synthetic co-polymer so as to make the synthetic co-polymer more hydrophilic. $Q^2$ possesses limited ability to hydrogen or covalently bond to cellulose fibers, such bonding resulting in an increase in stiffness of the tissue sheet. Suitable hydrophilic monomers or water-soluble nonionic monomers for use in the cationic synthetic co-polymers of the present invention include, but are not limited to, monomers, such as, hydroxyalkyl acrylates and hydroxyalkyl methacrylates, such as hydroxyethyl methacrylate (HEMA); hydroxyethyl acrylate; polyalkoxyl acrylates, such as polyethyleneglycol acrylates; and, polyalkoxyl methacrylates, such as polyethyleneglycol methacrylates ("PEG-MA"). Other suitable hydrophilic monomers or water-soluble nonionic monomers for use in the ion-sensitive cationic synthetic co-polymers of the present invention include, but are not limited to, diacetone acrylamide, N-vinylpyrrolidinone, and N-vinylformamide.

The mole ratio of z:x will specifically range from about 0:1 to about 4:1, more specifically from about 0:1 to about 1:1, and most specifically from about 0:1 to about 1:3. The mole ratio of (x+z):y may be from about 0.98:0.02 to about 1:1, and most specifically from about 0.95:0.05 to about 0.70:0.30.

The amount of the cationic synthetic co-polymer additive added to the papermaking fibers or the paper or tissue sheet may be from about 0.02 to about 5 weight percent, on a dry fiber basis, more specifically from about 0.05 to about 3 weight percent, and still more specifically from about 0.1 to about 2 weight percent. The synthetic co-polymer may be added to the fibers or paper or tissue sheet at any point in the process, but it can be particularly advantageous to add the synthetic co-polymer to the fibers while the fibers are suspended in water, before or after formation but prior to final drying of the sheet. This may include, for example, addition in the pulp mill or to the pulper, a machine chest, the headbox, or to the paper or tissue sheet prior to being dried where the consistency of the tissue sheet is about 80% or less.

In order to be an effective cationic synthetic co-polymer or cationic synthetic polymer additive suitable for use in tissue applications, the cationic synthetic co-polymer or cationic synthetic co-polymer additive should desirably be (1) water soluble or water dispersible; (2) safe (not toxic); and, (3) relatively economical. In addition to the foregoing factors, the cationic synthetic co-polymers and cationic synthetic co-polymer additives of the present invention, when used as a binder composition for a tissue sheet substrate, such as a facial, bath or towel product should be (4) processable on a commercial basis; i.e., may be applied relatively quickly on a large scale basis, such as by spraying (which thereby requires that the binder composition have a relatively low viscosity at high shear); and, (5) provide acceptable levels of sheet or substrate wettability. The cationic synthetic co-polymers and cationic synthetic co-polymer additives of the present invention and articles made therewith, especially facial tissue, bath tissue and towels comprising the particular compositions set forth below, can meet any or all of the above criteria. Of course, it is not necessary for all of the advantages of the preferred embodiments of the present invention to be met to fall within the scope of the present invention.

DETAILED DESCRIPTION OF THE INVENTION

Cationic Synthetic Co-polymer Formulations

Figure 1:
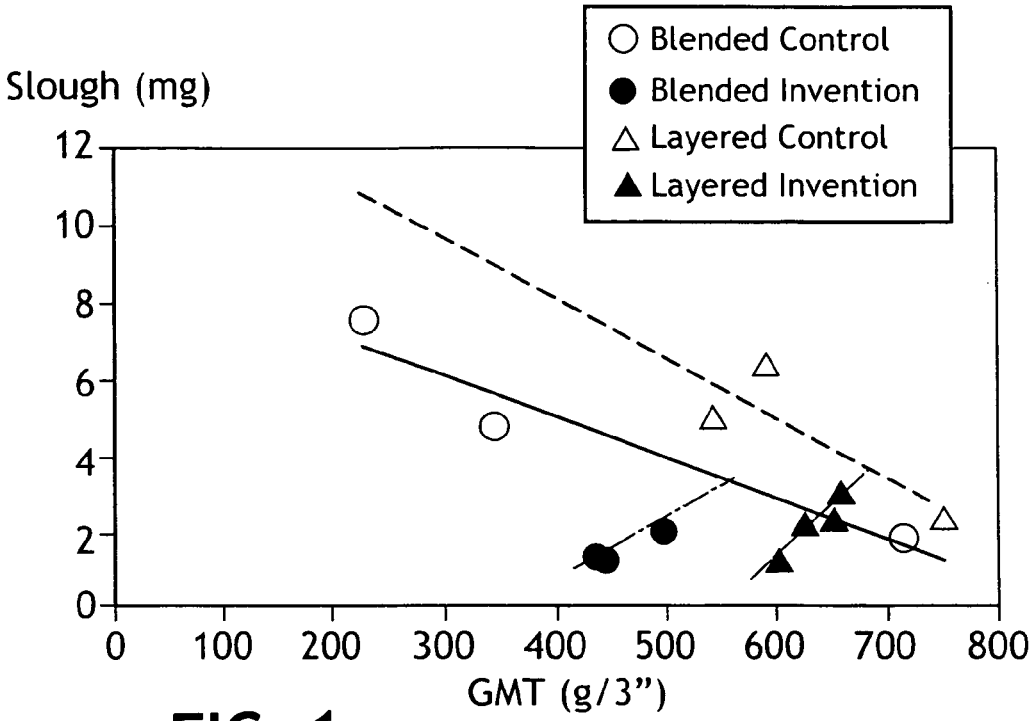
FIG. 1 is a graph comparing GMT and slough values for a topical application to a wet sheet of a particular synthetic co-polymer of the present invention and controls.

Suitable hydrophobic monomers for incorporating a hydrophobic functionality into the cationic synthetic co-polymers of the present invention include, but are not limited to, alkyl acrylates, methacrylates, acrylamides, methacrylamides, tiglates and crotonates, including butyl acrylate, butyl methacrylate, methyl acrylate, methyl methacrylate, ethyl acrylate, ethyl methacrylate, 1-Ethylhexyl tiglate, t-butyl acrylate, butyl crotonate, butyl tiglate, sec-Butyl tiglate, Hexyl tiglate, Isobutyl tiglate, hexyl crotonate, butyl crotonate, n-butyl acrylamide, t-butyl acrylamide, N-(Butoxymethyl)acrylamide, N-(Isobutoxymethyl)acrylamide, and the like including mixtures of the monomers all of which are known commercially available materials. Also known are various vinyl ethers including, but not limited to, n-butyl vinyl ether, 2-ethylhexyl vinyl ether, and the corresponding esters including vinyl pivalate, vinyl butyrate, 2-ethylhexanoate, and the like including mixtures of the monomers, all of which are suitable for incorporation of the hydrophobic aliphatic hydrocarbon moiety.

Suitable monomers for incorporating a cationic charge functionality into the synthetic co-polymer include, but are not limited to, [2-(methacryloyloxy)ethyl] trimethylammonium methosulfate (METAMS); dimethyldiallyl ammonium chloride (DMDAAC); 3-acryloamido-3-methyl butyl trimethyl ammonium chloride (AMBTAC); trimethylamino methacrylate; vinyl benzyl trimethyl ammonium chloride (VBTAC); 2-[(acryloyloxy)ethyl]trimethylammonium chloride; [2-(methacryloyloxy)ethyl] trimethylammonium chloride.

Examples of preferred cationic monomers for the cationic synthetic co-polymers of the present invention are [2-(methacryloyloxy)ethyl] trimethyl ammonium chloride, [2-(methacryloyloxy)ethyl] trimethyl ammonium methosulfate, [2-(methacryloyloxy)ethyl] trimethyl ammonium ethosulfate.

Suitable hydrophilic monomers or water-soluble nonionic monomers for use in the cationic synthetic co-polymers of the present invention include, but are not limited to N- and N,N-substituted acrylamide and methacrylamide based monomers, such as N,N-dimethyl acrylamide, N-ethyl acrylamide, N-isopropyl acrylamide, and hydroxymethyl acrylamide; acrylate or methacrylate based monomers, such as, hydroxyalkyl acrylates; hydroxyalkyl methacrylates, such as hydroxyethyl methacrylate (HEMA); hydroxyethyl acrylate; polyalkoxyl acrylates, such as polyethyleneglycol acrylates; and, polyalkoxyl methacrylates, such as polyethyleneglycol methacrylates ("PEG-MA"). Other suitable hydrophilic monomers or water-soluble nonionic monomers for use in the ion-sensitive cationic synthetic co-polymers of the present invention include, but are not limited to, N-vinylpyrrolidinone and N-vinylformamide.

For the cationic synthetic co-polymers of the present invention the mole % of hydrophobic monomers will range from about 40 mole % to about 98 mole % of the total monomer composition, the amount of cationic monomers will range from about 2 mole % to about 50 mole % of the total monomer composition. The amount of optional hydrophilic monomers will range from about 0 mole % to about 58 mole % of the total monomer composition. Most preferably, the mole percent of hydrophobic monomers is from about 50 mole % to about 95 mole % of the total monomer composition, the mole % of cationic monomers is most preferably from about 5 mole % to about 30 mole % of the total monomer composition, and the amount of optional hydrophilic monomers is most preferably from about 0 mole % to about 20 mole % of the total monomer composition.

The synthetic co-polymers of the present invention may have an average molecular weight average molecular weight ranging from about 10,000 to about 5,000,000. More specifically, the cationic water dispersible synthetic co-polymers of the present invention have a weight average molecular weight ranging from about 25,000 to about 2,000,000, or, more specifically still, from about 50,000 to about 1,000,000.

Another advantage to the disclosed cationic synthetic co-polymers is ability to produce sheets having low stiffness due to relatively low glass transition temperatures. While the cationic synthetic co-polymers of the present invention may have a wide range of glass transition temperature the glass transition temperature may be about 100° C. or less, more specifically about 70° C. or less, and most specifically about 40° C. or less. Some of the cationic synthetic co-polymers of the present invention may show more than one glass transition temperature. In such cases, the glass transition temperature of the lowest glass transition temperature may be about 100° C. or less, more specifically about 70° C. or less, and most specifically about 40° C. or less.

The cationic synthetic co-polymers of the present invention may be prepared according to a variety of polymerization methods, desirably a solution polymerization method. Suitable solvents for the polymerization method include, but are not limited to, lower alcohols such as methanol, ethanol and propanol; a mixed solvent comprising water and one or more lower alcohols mentioned above; and, a mixed solvent comprising water and one or more lower ketones such as acetone or methyl ethyl ketone.

In the polymerization methods which may be utilized in the present invention, any free radical polymerization initiator may be used. Selection of a particular polymerization initiator may depend on a number of factors including, but not limited to, the polymerization temperature, the solvent, and the monomers used. Suitable polymerization initiators for use in the present invention include, but are not limited to, 2,2'-azobisisobutyronitrile, 2,2'-azobis(2-methylbutyronitrile), 2,2'-azobis(2,4-dimethylvaleronitrile), 2,2'-azobis(2-amidinopropane)dihydrochloride, 2,2'-azobis(N,N'-dimethyleneisobutylamidine), potassium persulfate, ammonium persulfate, and aqueous hydrogen peroxide. The amount of polymerization initiator may desirably range from about 0.01 to about 5 weight percent based on the total weight of monomer present.

The polymerization temperature may vary depending on the polymerization solvent, monomers, and polymerization initiator used, but in general, ranges from about 20° C. to about 90° C. The polymerization time generally ranges from about 2 to about 8 hours.

The cationic synthetic co-polymer formulations of the present invention may also be delivered in emulsion form, whereby an aqueous polymerization process is used in conjunction with a surfactant or set of surfactants, such polymerization methods being known to those skilled in the art. The surfactants may be cationic or non-ionic, but more specifically non-ionic.

The amount of the cationic synthetic co-polymer additive added to the papermaking fibers or the paper or tissue sheet may be from about 0.01 to about 5 weight percent, on a dry fiber basis, more specifically from about 0.05 to about 3 weight percent, and still more specifically from about 0.1 to about 2 weight percent. The cationic synthetic co-polymer may be added to the papermaking fibers or the paper or tissue sheet at any point in the process. In one embodiment, the cationic synthetic co-polymers of the present invention may be added after the tissue sheet is formed, more specifically, to an existing wet tissue sheet. The solids level of the wet tissue sheet is preferably about 80% or lower (i.e., the tissue sheet comprises about 20 grams of dry solids and about 80 grams of water). More specifically, the solids level of the tissue sheet during the application of the cationic synthetic co-polymers may be most specifically about 60% or less, and most specifically about 50% or less. The application of the cationic synthetic co-polymer to the tissue sheet via this process may be accomplished by any method known in the art including but not limited to:

A spray applied to the fibrous tissue sheet. For example, spray nozzles may be mounted over a moving wet tissue sheet to apply a desired dose of a synthetic co-polymer chemical additive solution to the wet tissue sheet. Nebulizers can also be used to apply a light mist to a surface of a wet tissue sheet.

Non-contact printing methods such as ink jet printing, digital printing of any kind, and the like.

Coating onto one or both surfaces of the wet tissue sheet, such as blade coating, air knife coating, short dwell coating, cast coating, and the like.

Extrusion from a die head such as UFD spray tips, such as available from ITW-Dynatec of Henderson, Tenn., of the cationic synthetic co-polymer or cationic synthetic co-polymer additive in the form of a solution, a dispersion or emulsion, or a viscous mixture.

Impregnation of the wet tissue sheet with a solution or slurry, wherein the compound penetrates a significant distance into the thickness of the wet tissue sheet, such as about 20% or greater of the thickness of the wet tissue sheet, more specifically about 30% or greater, and most specifically about 70% or greater of the thickness of the wet tissue sheet, including completely penetrating the wet tissue sheet throughout the full extent of its thickness. One useful method for impregnation of a wet tissue sheet is the Hydra-Sizer® system, produced by Black Clawson Corp., Watertown, N.Y., as described in "New Technology to Apply Starch and Other Additives," Pulp and Paper Canada, 100(2): T42-T44 (Feb. 1999). This system consists of a die, an adjustable support structure, a catch pan, and an additive supply system. A thin curtain of descending liquid or slurry is created which contacts the moving tissue sheet beneath it. Wide ranges of applied doses of the coating material, such as the cationic synthetic co-polymer, or cationic synthetic co-polymer additive, may be achieved with good runnability. The system may also be applied to curtain coat a relatively dry tissue sheet, such as a tissue sheet just before or after creping.

Foam application of the cationic synthetic co-polymer or cationic synthetic co-polymer additive to the wet tissue sheet (e.g., foam finishing), either for topical application or for impregnation of the cationic synthetic co-polymer or cationic synthetic co-polymer additive into the wet tissue sheet under the influence of a pressure differential (e.g., vacuum-assisted impregnation of the foam). Principles of foam application of additives such as binder agents are described in U.S. Pat. No. 4,297,860, issued on Nov. 3, 1981 to Pacifici et al. and U.S. Pat. No. 4,773,110, issued on Sep. 27, 1988 to G. J. Hopkins, the disclosures of both which are herein incorporated by reference to the extent that they are non-contradictory herewith.

Application of the cationic synthetic co-polymer or cationic synthetic co-polymer additive by spray or other means to a moving belt or fabric which in turn contacts the tissue sheet to apply the cationic synthetic co-polymer or cationic synthetic co-polymer additive to the tissue sheet, such as is disclosed in WO 01/49937 under the name of S. Eichhorn, published on Jun. 12, 2001.

The cationic synthetic co-polymer or cationic synthetic co-polymer additive may also be added prior to formation of the tissue sheet such as when the fibers are suspended in water. This may include, for example, addition in the pulp mill or to the pulper, a machine chest, the headbox or to the tissue sheet prior to being dried where the consistency is about 80% or less.

The most preferred means for addition prior to the tissue sheet formation is direct addition to a fibrous slurry, such as by injection of the cationic synthetic co-polymer or cationic synthetic co-polymer additive into a fibrous slurry prior to entry in the headbox. Slurry consistency can be from about 0.2% to about 50%, specifically from about 0.2% to about 10%, more specifically from about 0.3% to about 5%, and most specifically from about 1% to about 4%.

Application of the cationic synthetic co-polymer or cationic synthetic co-polymer additive to individualized fibers. For example, comminuted or flash dried fibers may be entrained in an air stream combined with an aerosol or spray of the cationic synthetic co-polymer or cationic synthetic co-polymer additive to treat individual fibers prior to incorporation of the treated fibers into a tissue sheet or other fibrous product.

The tissue sheet comprising the cationic synthetic co-polymers of the present invention may be blended or layered sheets, wherein either a heterogeneous or homogeneous distribution of fibers is present in the z-direction of the sheet. In some embodiments, the cationic synthetic co-polymers may be added to all the fibers in the tissue sheet. In other embodiments, the cationic synthetic co-polymers may be added to only selective fibers in the tissue sheet, such methods being well known to those skilled in the art. In a specific embodiment of the present invention, the tissue sheet is a layered tissue sheet comprising two or more layers comprising distinct hardwood and softwood layers, wherein the cationic synthetic co-polymers of the present invention are added to only the hardwood fibers. In another embodiment, the cationic synthetic co-polymers of the present invention may be added to all the fibers.

The tissue sheet to be treated may be made by any method known in the art. The tissue sheet may be wetlaid, such as tissue sheet formed with known papermaking techniques wherein a dilute aqueous fiber slurry is disposed on a moving wire to filter out the fibers and form an embryonic tissue sheet which is subsequently dewatered by combinations of units including suction boxes, wet presses, dryer units, and the like. Examples of known dewatering and other operations are disclosed in U.S. Pat. No. 5,656,132, issued on Aug. 12, 1997 to Farrington, Jr. et al. Capillary dewatering may also be applied to remove water from the tissue sheet, as disclosed in U.S. Pat. No. 5,598,643, issued on Feb. 4, 1997 and U.S. Pat. No. 4,556,450, issued on Dec. 3, 1985, both to S. C. Chuang et al., the disclosures of both which are herein incorporated by reference to the extent that they are non-contradictory herewith.

Drying operations can include drum drying, through drying, steam drying such as superheated steam drying, displacement dewatering, Yankee drying, infrared drying, microwave drying, radiofrequency drying in general, and impulse drying, as disclosed in U.S. Pat. No. 5,353,521, issued on Oct. 11, 1994 to Orloff and U.S. Pat. No. 5,598,642, issued on Feb. 4, 1997 to Orloff et al., the disclosures of both which are herein incorporated by reference to the extent that they are non-contradictory herewith. Other drying technologies may be used, such as methods employing differential gas pressure include the use of air presses as disclosed U.S. Pat. No. 6,096,169, issued on Aug. 1, 2000 to Hermans et al. and U.S. Pat. No. 6,143,135, issued Nov. 7, 2000 to Hada et al., the disclosure of both which are herein incorporated by reference to the extent they are non-contradictory herewith. Also relevant are the paper machines disclosed in U.S. Pat. No. 5,230,776, issued on Jul. 27, 1993 to I. A. Andersson et al.

For tissue sheets, both creped and uncreped methods of manufacture may be used. Uncreped tissue production is disclosed in U.S. Pat. No. 5,772,845 issued on Jun. 30, 1998 to Farrington, Jr. et al., the disclosure of which is herein incorporated by reference to the extent that they are non-contradictory herewith. Creped tissue production is disclosed in U.S. Pat. No. 5,637,194, issued on Jun. 10, 1997 to Ampulski et al.; U.S. Pat. No. 4,529,480, issued on Jul. 16, 1985 to Trokhan; U.S. Pat. No. 6,103,063, issued on Aug. 15, 2000 to Oriaran et al.; and, U.S. Pat. No. 4,440,597, issued on Apr. 3, 1984 to Wells et al., the disclosures of all which are herein incorporated by reference to the extent that they are non-contradictory herewith. Also suitable for application of the synthetic co-polymers and synthetic co-polymer chemical additives of the present invention are tissue sheets that are pattern densified or imprinted, such as the tissue sheets disclosed in any of the following U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Steltjes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996, to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; and, U.S. Pat. No. 5,628,876, issued on May 13, 1997 to Ayers et al., the disclosures of which are incorporated herein by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits was deflected by an air pressure differential across the deflection conduit to form a lower-density pillow-like region or dome in the tissue sheet.

The term "tissue" as used herein is differentiated from other paper or tissue products in terms of its bulk. The bulk of the tissue products of the present invention is calculated as the quotient of the Caliper (hereinafter defined), expressed in microns, divided by the basis weight, expressed in grams per square meter. The resulting bulk is expressed as cubic centimeters per gram. Writing papers, newsprint and other such papers have higher strength and density (low bulk) in comparison to tissue products which tend to have much higher calipers for a given basis weight. For writing and printing papers, both bulk and surface strength are extremely important as well as high stiffness. The use of bulk or surface debonders to create bulk in papers other than tissue products goes against maximizing bulk and surface strength in printing papers. The tissue products of the present invention have a bulk about 2 $cm^3/g$ or greater, more specifically about 2.5 $cm^3/g$ or greater, and still more specifically about 3 $cm^3/g$ or greater.

Optional Chemical Additives

Optional chemical additives may also be added to the aqueous papermaking furnish or to the embryonic tissue sheet to impart additional benefits to the tissue product and process and are not antagonistic to the intended benefits of the present invention. The following materials are included as examples of additional chemicals that may be applied to the tissue sheet with the cationic synthetic co-polymers and cationic synthetic co-polymer additives of the present invention. The chemicals are included as examples and are not intended to limit the scope of the present invention. Such chemicals may be added at any point in the papermaking process, such as before or after addition of the cationic synthetic co-polymers and/or cationic synthetic co-polymer additives of the present invention. They may also be added simultaneously with the cationic copolymers and/or cationic synthetic co-polymer additives, either blended with the cationic synthetic co-polymers and/or cationic synthetic co-polymer additives of the present invention or as separate additives.

Charge Control Agents

Charge promoters and control agents are commonly used in the papermaking process to control the zeta potential of the papermaking furnish in the wet end of the process. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Strength Agents

Wet and dry strength agents may also be applied to the tissue sheet. As used herein, "wet strength agents" refer to materials used to immobilize the bonds between fibers in the wet state. Typically, the means by which fibers are held together in paper and tissue products involve hydrogen bonds and sometimes combinations of hydrogen bonds and covalent and/or ionic bonds. In the present invention, it may be useful to provide a material that will allow bonding of fibers in such a way as to immobilize the fiber-to-fiber bond points and make them resistant to disruption in the wet state. In this instance, the wet state usually will mean when the product is largely saturated with water or other aqueous solutions, but could also mean significant saturation with body fluids such as urine, blood, mucus, menses, runny bowel movement, lymph, and other body exudates.

Any material that when added to a tissue sheet or sheet results in providing the tissue sheet with a mean wet geometric tensile strength:dry geometric tensile strength ratio in excess of about 0.1 will, for purposes of the present invention, be termed a wet strength agent. Typically these materials are termed either as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50% of its original wet strength after exposure to water for a period of at least five minutes. Temporary wet strength agents are those which show about 50% or less than, of their original wet strength after being saturated with water for five minutes. Both classes of wet strength agents find application in the present invention. The amount of wet strength agent added to the pulp fibers may be about 0.1 dry weight percent or greater, more specifically about 0.2 dry weight percent or greater, and still more specifically from about 0.1 to about 3 dry weight percent, based on the dry weight of the fibers.

Permanent wet strength agents will typically provide a more or less long-term wet resilience to the structure of a tissue sheet. In contrast, the temporary wet strength agents will typically provide tissue sheet structures that had low density and high resilience, but would not provide a structure that had long-term resistance to exposure to water or body fluids.

Wet and Temporary Wet Strength Agents

The temporary wet strength agents may be cationic, nonionic or anionic. Such compounds include PAREZ™ 631 NC and PAREZ® 725 temporary wet strength resins that are cationic glyoxylated polyacrylamide available from Cytec Industries (West Paterson, N.J.). This and similar resins are described in U.S. Pat. No. 3,556,932, issued on Jan. 19, 1971 to Coscia et al. and U.S. Pat. No. 3,556,933, issued on Jan. 19, 1971 to Williams et al. Hercobond 1366, manufactured by Hercules, Inc., located at Wilmington, Del., is another commercially available cationic glyoxylated polyacrylamide that may be used in accordance with the present invention. Additional examples of temporary wet strength agents include dialdehyde starches such as Cobond® 1000 from National Starch and Chemical Company and other aldehyde containing polymers such as those described in U.S. Pat. No. 6,224,714 issued on May 1, 2001 to Schroeder et al.; U.S. Pat. No. 6,274,667 issued on Aug. 14, 2001 to Shannon et al.; U.S. Pat. No. 6,287,418 issued on Sep. 11, 2001 to Schroeder et al.; and, U.S. Pat. No. 6,365,667 issued on Apr. 2, 2002 to Shannon et al., the disclosures of which are herein incorporated by reference to the extend they are non-contradictory herewith.

Permanent wet strength agents comprising cationic oligomeric or polymeric resins may be used in the present invention. Polyamide-polyamine-epichlorohydrin type resins such as KYMENE 557H sold by Hercules, Inc., located at Wilmington, Del., are the most widely used permanent wet-strength agents and are suitable for use in the present invention. Such materials have been described in the following U.S. Pat. No. 3,700,623 issued on Oct. 24, 1972 to Keim; U.S. Pat. No. 3,772,076 issued on Nov. 13, 1973 to Keim; U.S. Pat. No. 3,855,158 issued on Dec. 17, 1974 to Petrovich et al.; U.S. Pat. No. 3,899,388 issued on Aug. 12, 1975 to Petrovich et al.; U.S. Pat. No. 4,129,528 issued on Dec. 12, 1978 to Petrovich et al.; U.S. Pat. No. 4,147,586 issued on Apr. 3, 1979 to Petrovich et al.; and, U.S. Pat. No. 4,222,921 issued on Sep. 16, 1980 to van Eenam. Other cationic resins include polyethylenimine resins and aminoplast resins obtained by reaction of formaldehyde with melamine or urea. It is often advantageous to use both permanent and temporary wet strength resins in the manufacture of tissue products with such use being recognized as falling within the scope of the present invention.

Dry Strength Agents

Dry strength agents may also be applied to the tissue sheet without affecting the performance of the disclosed cationic synthetic co-polymers of the present invention. Such materials used as dry strength agents are well known in the art and include but are not limited to modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. It may at times, however, be beneficial to blend the dry strength agent with the cationic synthetic co-polymers of the present invention and apply the two chemicals simultaneously to the tissue sheet.

Additional Softening Agents

At times it may be advantageous to add additional debonders or softening chemistries to a tissue sheet. Examples of such debonders and softening chemistries are broadly taught in the art. Exemplary compounds include the simple quaternary ammonium salts having the general formula $(R^{1'})_{4-b}$—$N^+$—$(R^{1''})_bX^-$ wherein R1' is a C1-6 alkyl group, R1" is a C14-C22 alkyl group, b is an integer from 1 to 3 and X— is any suitable counterion. Other similar compounds include the monoester, diester, monoamide and diamide derivatives of the simple quaternary ammonium salts. A number of variations on these quaternary ammonium compounds are known and should be considered to fall within the scope of the present invention. Additional softening compositions include cationic oleyl imidazoline materials such as methyl-1-oleyl amidoethyl-2-oleyl imidazolinium methylsulfate commercially available as Mackernium DC-183 from McIntyre Ltd., located in University Park, Ill. and Prosoft TQ-1003 available from Hercules, Inc. Such softeners may also incorporate a humectant or a plasticizer such as a low molecular weight polyethylene glycol (molecular weight of about 4,000 daltons or less) or a polyhydroxy compound such as glycerin or propylene glycol. While these softeners may be applied to the fibers while in slurry prior to sheet formation, the cationic synthetic co-polymers of the present invention typically provide sufficient debonding and softness improvement so as not to require use of additional bulk softening agents.

However, it may be particularly advantageous to add such softening agents simultaneously with the cationic synthetic co-polymers of the present invention to a formed tissue sheet at a consistency of about 80% or less. In such situations, dilute solutions of the softening composition and cationic synthetic co-polymer are blended directly and then topically applied to the wet tissue sheet. It is believed in this manner that tactile softness of the tissue sheet and resulting tissue products may be improved due to presence of the additional softening compound. An especially preferred topical softener for this application is polysiloxane. The use of polysiloxanes to soften tissue sheets is broadly taught in the art. A large variety of polysiloxanes are available that are capable of enhancing the tactile properties of the finished tissue sheet. Any polysiloxane capable of enhancing the tactile softness of the tissue sheet is suitable for incorporation in this manner so long as so long as solutions or emulsions of the softener and polysiloxane are compatible, that is when mixed they do not form gels, precipitates or other physical defects that would preclude application to the tissue sheet.

Examples of suitable polysiloxanes include but are not limited to linear polydialkyl polysiloxanes such as the DC-200 fluid series available from Dow Corning, Inc., Midland, Mich. as well as the organo-reactive polydimethyl siloxanes such as the preferred amino functional polydimethyl siloxanes. Examples of suitable polysiloxanes include those described in U.S. Pat. No. 6,054,020 issued on Apr. 25, 2000 to Goulet et al. and U.S. Pat. No. 6,432,270 issued on Aug. 13, 2002 to Liu et al., the disclosures of which are herein incorporated by reference to the extent that they are non-contradictory herewith. Additional exemplary aminofunctional polysiloxanes are the Wetsoft CTW family manufactured and sold by Wacker Chemie, Munich, Germany.

Miscellaneous Agents

It may be desirable to treat a tissue sheet with additional types of chemicals. Such chemicals include, but are not limited to, absorbency aids usually in the form of cationic, anionic, or non-ionic surfactants, humectants and plasticizers such as low molecular weight polyethylene glycols and polyhydroxy compounds such as glycerin and propylene glycol.

In general, the cationic synthetic co-polymers of the present invention may be used in conjunction with any known materials and chemicals that are not antagonistic to its intended use. Examples of such materials and chemicals include, but are not limited to, odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, polysiloxanes and the like. A wide variety of other materials and chemicals known in the art of papermaking and tissue production may be included in the tissue sheets of the present invention including lotions and other materials providing skin health benefits.

The application point for such materials and chemicals is not particularly relevant to the present invention and such materials and chemicals may be applied at any point in the tissue manufacturing process. This includes pre-treatment of pulp, co-application in the wet end of the process, post treatment after drying but on the tissue machine and topical post treatment.

A surprising aspect of the present invention is that despite use of the hydrophobically modified cationic synthetic copolymers, the tissue sheets still remain absorbent. The Wet Out Time (hereinafter defined) for treated tissue sheets of the present invention may be about 180 seconds or less, more specifically about 150 seconds or less, still more specifically about 120 seconds or less, and still more specifically about 90 seconds or less. As used herein, the term "Wet Out Time" is related to absorbency and is the time it takes for a given sample of a tissue sheet to completely wet out when placed in water.

Experimental

Basis Weight Determination (Tissue)

The basis weight and bone dry basis weight of the tissue sheet specimens was determined using a modified TAPPI T410 procedure. As is basis weight samples were conditioned at 23° C.±1° C. and 50±2% relative humidity for a minimum of 4 hours. After conditioning a stack of 16–3"×3" samples was cut using a die press and associated die. This represents a tissue sheet sample area of 144 $in^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram on a tared analytical balance. The basis weight in pounds per 2880 $ft^2$ is then calculated using the following equation:

$$\text{Basis weight}=\text{stack wt. in grams}/454*2880$$

The bone dry basis weight is obtained by weighing a sample can and sample can lid the nearest 0.001 grams (this weight is A). The sample stack is placed into the sample can and left uncovered. The uncovered sample can and stack along with the sample can lid is placed in a 105° C.±2° C. oven for a period of 1 hour±5 minutes for sample stacks weighing less than 10 grams and at least 8 hours for sample stacks weighing 10 grams or greater. After the specified oven time has lapsed, the sample can lid is placed on the sample can and the sample can is removed from the oven. The sample can is allowed to cool to approximately ambient temperature but no more than 10 minutes. The sample can, sample can lid and sample stack are then weighed to the nearest 0.001 gram (this weight is C). The bone dry basis weight in pounds/2880 $ft^2$ is calculated using the following equation:

$$\text{Bone Dry BW}=(C-A)/454*2880$$

Dry Tensile (Tissue):

The Geometric Mean Tensile (GMT) strength test results are expressed as grams-force per 3 inches of sample width. GMT is computed from the peak load values of the MD (machine direction) and CD (cross-machine direction) tensile curves, which are obtained under laboratory conditions of 23.0° C.±1.0° C., 50.0±2.0% relative humidity, and after the tissue sheet has equilibrated to the testing conditions for a period of not less than four hours. Testing is conducted on a tensile testing machine maintaining a constant rate of elongation, and the width of each specimen tested was 3 inches. The "jaw span" or the distance between the jaws, sometimes referred to as gauge length, is 2.0 inches (50.8 mm). The crosshead speed is 10 inches per minute (254 mm/min.) A load cell or full-scale load is chosen so that all peak load results fall between 10 and 90 percent of the full-scale load. In particular, the results described herein were produced on an Instron 1122 tensile frame connected to a Sintech data acquisition and control system utilizing IMAP software running on a "486 Class" personal computer. This data system records at least 20 load and elongation points per second. A total of 10 specimens per sample are tested with the sample mean being used as the reported tensile value. The geometric mean tensile is calculated from the following equation:

$$\text{GMT}=(\text{MD Tensile}*\text{CD Tensile})^{1/2}$$

To account for small variations in basis weight, GMT values were then corrected to the 18.5 pounds/2880 $ft^2$ target basis weight using the following equation:

$$\text{Corrected GMT}=\text{Measured GMT}*(18.5/\text{Bone Dry Basis Weight})$$

Caliper:

The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up. Caliper is expressed in microns. Caliper was measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals).

Figure 8:
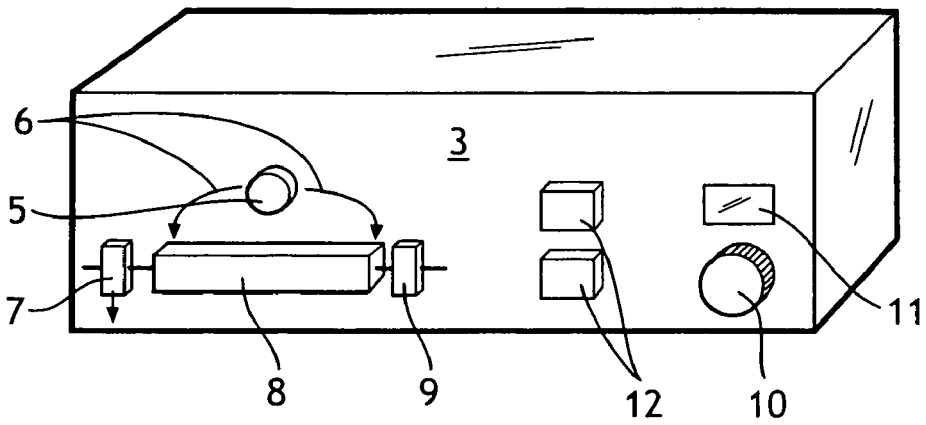
FIG. 8 is a schematic diagram of testing equipment used to measure lint and slough.

Lint and Slough Measurement:

In order to determine the abrasion resistance, or tendency of the fibers to be rubbed from the tissue sheet when handled, each sample was measured by abrading the tissue specimens via the following method. This test measures the resistance of a material to an abrasive action when the material is subjected to a horizontally reciprocating surface abrader. The equipment and method used is similar to that described in U.S. Pat. No. 4,326,000, issued on Apr. 20, 1982 to Roberts, Jr. and assigned to the Scott Paper Company, the disclosure of which is herein incorporated by reference to the extent that it is non-contradictory herewith. All tissue sheet samples were conditioned at 23° C.±1° C. and 50±2% relative humidity for a minimum of 4 hours. FIG. 8 is a schematic diagram of the test equipment. Shown is the abrading spindle or mandrel 5, a double arrow 6 showing the motion of the mandrel 5, a sliding clamp 7, a slough tray 8, a stationary clamp 9, a cycle speed control 10, a counter 11, and start/stop controls 12.

The abrading spindle 5 consists of a stainless steel rod, 0.5" in diameter with the abrasive portion consisting of a 0.005" deep diamond pattern knurl extending 4.25" in length around the entire circumference of the rod. The abrading spindle 5 is mounted perpendicularly to the face of the instrument 3 such that the abrasive portion of the abrading spindle 5 extends out its entire distance from the face of the instrument 3. On each side of the abrading spindle 5 is located a pair of clamps 7 and 9, one movable 7 and one fixed 9, spaced 4" apart and centered about the abrading spindle 5. The movable clamp 7 (weighing approximately 102.7 grams) is allowed to slide freely in the vertical direction, the weight of the movable clamp 7 providing the means for insuring a constant tension of the tissue sheet sample over the surface of the abrading spindle 5.

Using a JDC-3 or equivalent precision cutter, available from Thwing-Albert Instrument Company, located at Philadelphia, Pa., the tissue sheet sample specimens are cut into 3"±0.05" wide×7" long strips (note: length is not critical as long as specimen can span distance so as to be inserted into the clamps A & B). For tissue sheet samples, the MD direction corresponds to the longer dimension. Each tissue sheet sample is weighed to the nearest 0.1 mg. One end of the tissue sheet sample is clamped to the fixed clamp 9, the sample then loosely draped over the abrading spindle or mandrel 5 and clamped into the sliding clamp 7. The entire width of the tissue sheet sample should be in contact with the abrading spindle 5. The sliding clamp 7 is then allowed to fall providing constant tension across the abrading spindle 5.

The abrading spindle 5 is then moved back and forth at an approximate 15 degree angle from the centered vertical centerline in a reciprocal horizontal motion against the tissue sheet sample for 20 cycles (each cycle is a back and forth stroke), at a speed of 170 cycles per minute, removing loose fibers from the surface of the tissue sheet sample. Additionally the spindle rotates counter clockwise (when looking at the front of the instrument) at an approximate speed of 5 RPMs. The tissue sheet sample is then removed from the jaws 7 and 9 and any loose fibers on the surface of the tissue sheet sample are removed by gently shaking the tissue sheet sample. The tissue sheet sample is then weighed to the nearest 0.1 mg and the weight loss calculated. Ten tissue sheet specimen per sample are tested and the average weight loss value in mg recorded. The result for each tissue sheet sample was compared with a control sample containing no chemicals. Where a 2-layered tissue sheet sample is measured, placement of the tissue sheet sample should be such that the hardwood portion is against the abrading surface.

Wet Out Time

The Wet Out Time of a tissue sheet treated in accordance with the present invention is determined by cutting 20 sheets of the tissue sheet sample into 2.5 inch squares. The number of sheets of the tissue sheet sample used in the test is independent of the number of plies per sheet of the tissue sheet sample. The 20 square sheets of the tissue sheet sample are stacked together and stapled at each corner to form a pad of the tissue sheet sample. The pad of the tissue sheet sample is held close to the surface of a constant temperature distilled water bath (23° C.±2° C.), which is the appropriate size and depth to ensure the saturated pad of the tissue sheet sample does not contact the bottom of the water bath container and the top surface of the distilled water of the water bath at the same time, and dropped flat onto the surface of the distilled water, with staple points on the pad of the tissue sheet sample facing down. The time necessary for the pad of the tissue sheet sample to become completely saturated, measured in seconds, is the Wet Out Time for the tissue sheet sample and represents the absorbent rate of the tissue sheet sample. Increases in the Wet Out Time represent a decrease in absorbent rate of the tissue sheet sample.

Softness:

Softness of tissue sheets and/or tissue products is determined from sensory panel testing. The testing is performed by trained panelists who rub the formed tissue sheets and/or tissue products and compare the softness attributes of the tissue sheets and/or tissue products to the same softness attributes of high and low softness control standards. After comparing these characteristics to the standards, the panelists assign a value for each of the tissue sheets' and/or tissue products' softness attributes. From these values an overall softness of the tissue sheets and/or tissue products determined on a scale from 1 (least soft) to 16 (most soft). The higher the number, the softer the tissue sheet and/or tissue product. In general, a difference of less than 0.5 in the panel softness value is not statistically significant.

EXAMPLES

Example 1

Example 1 demonstrates the preparation of a blended (non-layered) tissue basesheet. The blended tissue basesheet was made according to the following procedure. About 45.5 pounds (oven dry basis) of eucalyptus hardwood kraft fiber and about 24.5 pounds (oven dry basis) of northern softwood kraft fiber were dispersed in a pulper for about 30 minutes at a consistency of about 3%. The blended thick stock pulp slurry was refined for 10 minutes and then passed to a machine chest where the thick stock pulp slurry was diluted to a consistency of about 1%. Kymene 6500, a commercially available PAE wet strength resin from Hercules, Inc., was added to the pulp slurry in the machine chest at a rate of about 4 pounds of dry chemical per ton of dry fiber. The stock pulp slurry was further diluted to about 0.1 percent consistency prior to forming and deposited from an unlayered headbox onto a fine forming fabric having a velocity of about 50 feet per minute to form a 17" wide tissue sheet. The flow rate of the stock pulp slurry in the flow spreader was adjusted to give a target sheet basis weight of 12.7 gsm. The stock pulp slurry drained through the forming fabric, building an embryonic tissue sheet. The embryonic tissue sheet was transferred to a second fabric, a papermaking felt, before being further dewatered using a vacuum box to a consistency of between about 15 to about 25%. The tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the blended tissue basesheet.

An aqueous creping composition was prepared containing about 0.317% by weight of polyvinyl alcohol (PVOH), available under the trade designation of Celvol 523 manufactured by Celanese, Dallas, Tex. (88% hydrolyzed and a viscosity of about 23 to about 27 cps. for a 4% solution at 20° C.); about 0.01% by weight of a PAE resin, available under the trade designation of Kymene 6500 from Hercules, Inc.; and, about 0.001% of a debonder/creping release agent, available under the trade designation of Resozol 2008, manufactured by Hercules, Inc. All weight percentages are based on dry pounds of the chemical being discussed. The creping composition was prepared by adding the specific amount of each chemical to 10 gallons of water and mixing well. PVOH was obtained as a 6% aqueous solution; Kymene 557 as a 12.5% aqueous solution; and, Resozol 2008 as a 7% solution in IPA/water. The creping composition was then applied to the Yankee dryer surface via a spray boom at a pressure of about 60 psi at a rate of about 0.25 g solids/$m^2$ of product. The finished blended tissue basesheet was then converted into a 2-ply tissue product with the dryer side of each ply facing outward.

Example 2

Example 2 demonstrates use of a conventional wet end debonder for preparing soft tissue products. The blended tissue basesheet used in this example was made in general accordance with Example 1. The Prosoft TQ-1003 was diluted to 1% solids with water prior to addition to the machine chest. The diluted Prosoft TQ-1003, a cationic oleylimidazoline debonder, commercially available from Hercules, Inc. was added to the machine chest. The machine chest was then allowed to stir for about 5 minutes prior to start of the tissue sheet formation. The amount of debonder to total tissue basesheet fiber on a dry weight basis was about 0.1%. The finished blended tissue basesheet was then converted into a 2-ply facial tissue product with the dryer side of each ply facing outward.

Example 3

Example 3 demonstrates use of a conventional wet end debonder for preparing soft tissue products. The blended tissue basesheet used in this example was made in general accordance with Example 1. The Prosoft TQ-1003 was diluted to about 1% solids with water prior to addition to the machine chest. The diluted Prosoft TQ-1003, a cationic oleylimidazoline debonder, commercially available from Hercules, Inc. was added to the machine chest. The machine chest was then allowed to stir for about 5 minutes prior to start of the tissue sheet formation. The amount of debonder to total tissue basesheet fiber on a dry weight basis was about 0.2%. The finished blended tissue basesheet was then converted into a 2-ply facial tissue product with the dryer side of each ply facing outward.

Example 4

Example 4 demonstrates the topical application of cationic synthetic co-polymer of the present invention to a wet, blended tissue basesheet prior to drying the blended tissue basesheet. The blended tissue basesheet used in this example was prepared in general accordance with Example 1. A 30% by weight aqueous dispersion of a cationic synthetic co-polymer of the present invention containing 80 mole % of n-butyl acrylate and 20 mole % of [2-(methacryloyloxy) ethyl] trimethyl ammonium chloride was diluted with water and sprayed onto the side of the tissue basesheet that is later brought into contact with the Yankee dryer. The blended tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.1%. The finished blended tissue basesheet was then converted into a 2-ply facial tissue product with the dryer side of each ply facing outward.

Example 5

Example 5 demonstrates the topical application of cationic synthetic co-polymer of the present invention to a wet, blended tissue basesheet prior to drying the blended tissue basesheet. The blended tissue basesheet used in this example was prepared in general accordance with Example 1. A 30% by weight aqueous dispersion of a cationic synthetic co-polymer of the present invention containing 80 mole % of n-butyl acrylate and 20 mole % of [2-(methacryloyloxy) ethyl] trimethyl ammonium chloride was diluted with water and sprayed onto the side of the tissue basesheet that is later brought into contact with the Yankee dryer. The blended tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total sheet fiber on a dry weight basis was about 0.2%. The finished blended tissue basesheet was then converted into a 2-ply facial tissue product with the dryer side of each ply facing outward.

Example 6

Example 6 demonstrates the topical application of cationic synthetic co-polymer of the present invention to a wet, blended tissue basesheet prior to drying the blended tissue basesheet. The blended tissue basesheet used in this example was prepared in general accordance with Example 1. A 30% by weight aqueous dispersion of a cationic synthetic co-polymer of the present invention containing 80 mole % of n-butyl acrylate and 20 mole % of [2-(methacryloyloxy) ethyl] trimethyl ammonium chloride was diluted with water and sprayed onto the side of the tissue basesheet that is later brought into contact with the Yankee dryer. The blended tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.4%. The finished blended tissue basesheet was then converted into a 2-ply facial tissue product with the dryer side of each ply facing outward.

Figure 2:
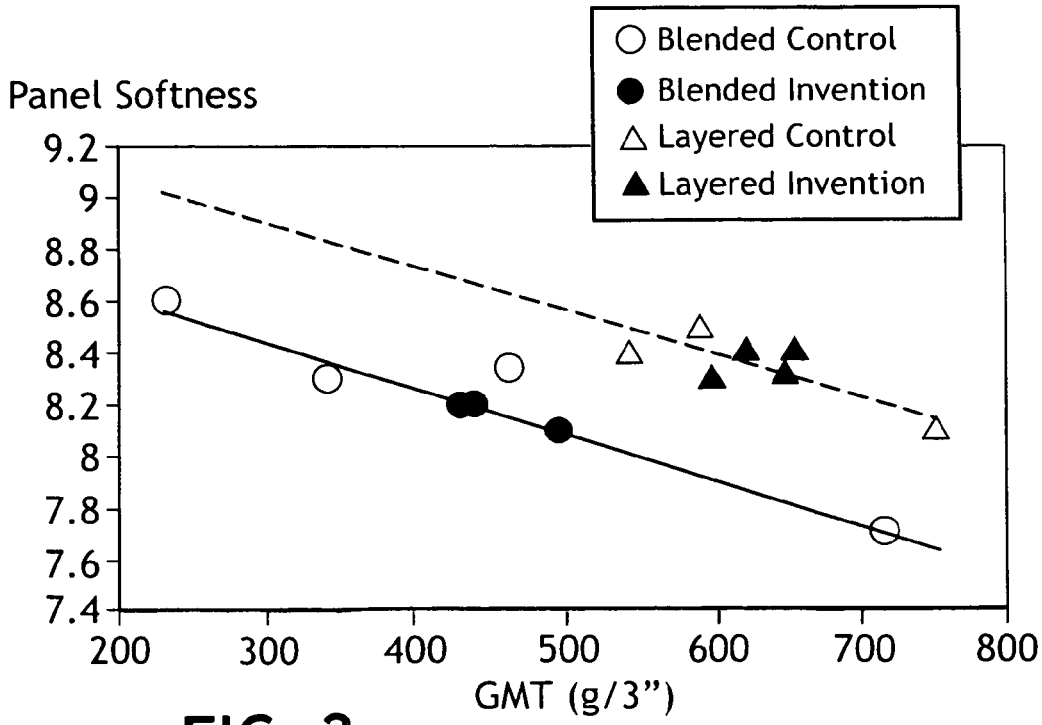
FIG. 2 is a graph comparing GMT and softness values for a topical application to a wet sheet of a particular synthetic co-polymer of the present invention and controls.
Figure 3:
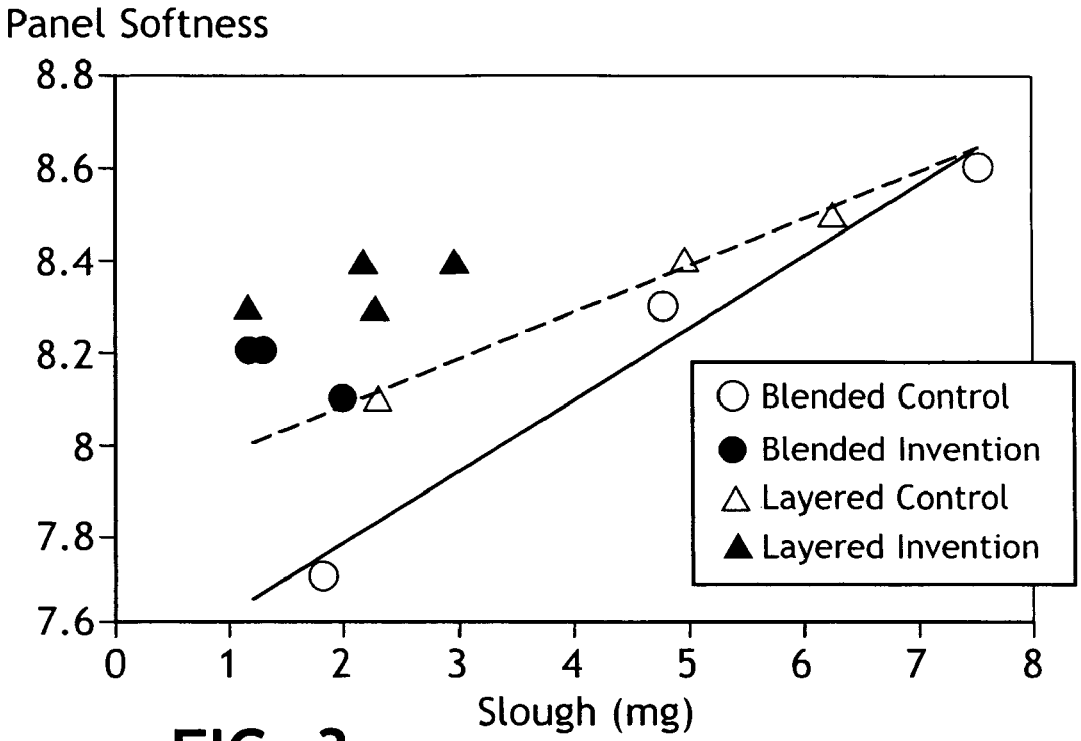
FIG. 3 is a graph comparing slough and softness values for a topical application to a wet sheet of a particular synthetic co-polymer of the present invention and controls.

Table 1 summarizes the data for Examples 1-6. FIG. 1 shows graphically the relationship between slough and tensile. Both Table 1 and FIG. 1 demonstrate the cationic synthetic co-polymers of the present invention simultaneously reducing slough and strength when applied topically to a wet, formed tissue sheet. Furthermore, the softness data shown in Table 3 and graphically in FIG. 2 shows that the tissue products treated with the cationic synthetic co-polymers of the present invention follow the same strength/softness technology curve as the standard cationic oleylimidazoline debonder. Hence, the tissue products that have lower slough at equivalent softness are obtained as shown in FIG. 3. Also given in a Table 1 are wet-out times showing that the tissue products of the present invention retain their absorbent properties.

TABLE 1

| Example | Additive | Amount % of Dry Fiber | Wet-out time, s | Slough, mg | GMT |
|---|---|---|---|---|---|
| 1 | None | 0 | 16 | 1.8 | 717 |
| 2 | Prosoft TQ-1003 | 0.1% | 3 | 4.8 | 346 |
| 3 | Prosoft TQ-1003 | 0.2% | 3 | 7.6 | 232 |
| 4 | Invention | 0.1% | 13 | 2.0 | 496 |
| 5 | Invention | 0.2% | 18 | 1.3 | 433 |
| 6 | Invention | 0.4% | 18 | 1.2 | 441 |

Example 7

Example 7 demonstrates the preparation of a layered tissue basesheet. About 70 pounds, oven dried basis, of eucalyptus hardwood kraft pulp fibers were dispersed in a pulper for about 30 minutes, forming an eucalyptus hardwood pulp kraft fiber slurry having a consistency of about 3%. The Eucalyptus pulp hardwood kraft fiber slurry was then transferred to two machine chests and diluted to a consistency of about 0.5 to about 1%. About 70 pounds, oven dry basis, of LL-19 northern softwood kraft pulp fibers were dispersed in a pulper for about 30 minutes, forming a northern softwood kraft pulp fiber slurry having a consistency of about 3%. A low level of refining was applied for about 12 minutes to the softwood kraft pulp fibers. After dispersing, the northern softwood kraft pulp fibers to form the slurry, the northern softwood kraft pulp fibers were passed to a machine chest and diluted to a consistency of between about 0.5 to about 1%.

Kymene 6500, a commercially available PAE wet strength resin from Hercules, Inc., was added to both the eucalyptus hardwood and northern softwood kraft pulp slurries in the machine chest at a rate of about 4 pounds of dry chemical per ton of dry fiber. The stock pulp fiber slurries were further diluted to approximately about 0.1 percent consistency prior to forming and deposited from a three layered headbox onto a fine forming fabric having a velocity of about 50 feet per minute to form a 17" wide tissue sheet. The flow rates of the stock pulp fiber slurries into the flow spreader were adjusted to give a target sheet basis weight of about 12.7 gsm and a layer split of 35% Eucalyptus hardwood kraft pulp fibers on both outer layers and 30% LL-19 northern softwood kraft pulp fibers in the center layer. The stock pulp fiber slurries were drained on the forming fabric, building a layered embryonic tissue sheet. The embryonic tissue sheet was transferred to a second fabric, a papermaking felt, before being further dewatered with a vacuum box to a consistency of between about 15 to about 25%. The embryonic tissue sheet was then transferred via a pressure roll to a steam heated Yankee dryer operating at a temperature of about 220° F. at a steam pressure of about 17 PSI. The dried tissue sheet was then transferred to a reel traveling at a speed about 30% slower than the Yankee dryer to provide a crepe ratio of about 1.3:1, thereby providing the layered tissue basesheet.

An aqueous creping composition was prepared containing about 0.317% by weight of polyvinyl alcohol (PVOH), available under the trade designation of Celvol 523 manufactured by Celanese (88% hydrolyzed with a viscosity of about 23 to about 27 cps. for a 4% solution at 20° C.); about 0.01% by weight of a PAE resin, available under the trade designation of Kymene 6500 from Hercules, Inc.; and, about 0.001% of a debonder/creping release agent, Resozol 2008, manufactured by Hercules, Inc. All weight percentages are based on dry pounds of the chemical being discussed. The creping composition was prepared by adding the specific amount of each chemical to 10 gallons of water and mixing well. PVOH was obtained as a 6% aqueous solution; Kymene 557 as a 12.5% aqueous solution; and, Resozol 2008 as a 7% solution in IPA/water. The creping composition was then applied to the Yankee dryer surface via a spray boom at a pressure of about 60 psi at a rate of about 0.25 g solids/$m^2$ of product. The finished layered basesheet was then converted into a 2-ply tissue product with the dryer side layer of each ply facing outward. See Table 4 showing physical properties of blended tissue basesheets. GMT was normalized to the basis weight of the untreated tissue sheet.

Example 8

Example 8 demonstrates use of a conventional wet end debonder for preparing soft tissue products. The layered tissue basesheet used in this example was made in general accordance with Example 7. The Prosoft TQ-1003 was diluted to about 1% solids with water prior to addition to the machine chest. The diluted Prosoft TQ-1003, a cationic oleylimidazoline debonder, commercially available from Hercules, Inc. was added to the machine chest containing the eucalyptus hardwood kraft pulp fiber slurry going to the layer that would come into contact with the dryer. The machine chest was then allowed to stir for about 5 minutes prior to start of the tissue sheet formation. The amount of debonder relative to total dried fiber of the tissue basesheet was about 0.025%. The finished layered tissue basesheets were then converted into a 2-ply facial tissue product with the dryer side layer of each ply facing outward.

Example 9

Example 9 demonstrates use of a conventional wet end debonder for preparing soft tissue products. The layered tissue basesheet used in this example was made in general accordance with Example 7. The Prosoft TQ-1003 was diluted to about 1% solids with water prior to addition to the machine chest. The diluted Prosoft TQ-1003, a cationic oleylimidazoline debonder, commercially available from Hercules, Inc. was added to the machine chest containing the eucalyptus hardwood kraft pulp fiber slurry going to the layer that would come into contact with the dryer. The machine chest was then allowed to stir for about 5 minutes prior to start of the tissue sheet formation. The amount of debonder to total tissue basesheet fiber on a dry weight basis was about 0.05%. The finished layered tissue basesheets were then converted into a 2-ply facial tissue product with the dryer side layer of each ply facing outward.

Example 10

Example 10 demonstrates the topical application of cationic synthetic co-polymer of the present invention to a wet, layered tissue basesheet prior to drying the layered tissue basesheet. The layered tissue basesheet used in this example was prepared in general accordance with Example 7. A 30% by weight aqueous dispersion of a cationic synthetic co-polymer of the present invention containing 80 mole % n-butyl acrylate and 20 mole % of [2-(methacryloyloxy)ethyl] trimethyl ammonium chloride was diluted with water and sprayed onto the side of the layered tissue basesheet that is later brought into contact with the Yankee dryer. The layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.1%. The finished layered tissue basesheet was then converted into a 2-ply facial tissue product with the dryer side layer of each ply facing outward.

Example 11

Example 11 demonstrates the topical application of cationic synthetic co-polymer of the present invention to a wet, layered tissue basesheet prior to drying the layered tissue basesheet. The layered tissue basesheet used in this example was prepared in general accordance with Example 7. A 30% by weight aqueous dispersion of a cationic synthetic co-polymer of the present invention containing 80 mole % n-butyl acrylate and 20 mole % of [2-(methacryloyloxy)ethyl] trimethyl ammonium chloride was diluted with water and sprayed onto the side of the layered tissue basesheet that is later brought into contact with the Yankee dryer. The layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.2%. The finished layered tissue basesheet was then converted into a 2-ply facial tissue product with the dryer side layer of each ply facing outward.

Example 12

Example 12 demonstrates the topical application of cationic synthetic co-polymer of the present invention to a wet, layered tissue basesheet prior to drying the layered tissue basesheet. The layered tissue basesheet used in this example was prepared in general accordance with Example 7. A 30% by weight aqueous dispersion of a cationic synthetic co-polymer of the present invention containing 80 mole % n-butyl acrylate and 20 mole % of [2-(methacryloyloxy)ethyl] trimethyl ammonium chloride was diluted with water and sprayed onto the side of the layered tissue basesheet that is later brought into contact with the Yankee dryer. The layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.4%. The finished layered tissue basesheet was then converted into a 2-ply facial tissue product with the dryer side layer of each ply facing outward.

Example 13

Example 13 demonstrates the topical application of cationic synthetic co-polymer of the present invention to a wet, layered tissue basesheet prior to drying the layered tissue basesheet. The layered tissue basesheet used in this example was prepared in general accordance with Example 7. A 30% by weight aqueous dispersion of a cationic synthetic co-polymer of the present invention containing 80 mole % n-butyl acrylate and 20 mole % of [2-(methacryloyloxy)ethyl] trimethyl ammonium chloride was diluted with water and sprayed onto the side of the layered tissue basesheet that is later brought into contact with the Yankee dryer. The layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.8%. The finished layered tissue basesheet was then converted into a 2-ply facial tissue product with the dryer side layer of each ply facing outward.

Table 2 summarizes the data for Examples 7-12. FIG. 1 shows graphically the relationship between slough and tensile. Both Table 2 and FIG. 1 demonstrate the cationic synthetic co-polymers of the present invention simultaneously reducing slough and strength when applied topically to a wet, formed tissue sheet. Furthermore, the softness data shown in Table 3 and graphically in FIG. 2 shows that the tissue products treated with the cationic synthetic co-polymers of the present invention follow the same strength/softness technology curve as the standard cationic oleylimidazoline debonder. Hence, tissue products that have lower slough at equivalent softness are obtained as shown in FIG. 3. Also given in Table 2 are wet-out times showing that the tissue products of the present invention retain their absorbent properties.

TABLE 2

| Example | Additive | Amount % of Total Sheet Dry Fiber | Wet-out time, s | Slough, mg | GMT |
|---|---|---|---|---|---|
| 7 | None | 0 | 18 | 2.3 | 753 |
| 8 | Prosoft TQ-1003 | 0.025% | 6 | 6.3 | 594 |
| 9 | Prosoft TQ-1003 | 0.05% | 5 | 5.0 | 544 |
| 10 | Invention | 0.1% | 18 | 2.2 | 627 |
| 11 | Invention | 0.2% | 17 | 3.0 | 660 |
| 12 | Invention | 0.4% | 18 | 2.3 | 652 |
| 13 | Invention | 0.8% | 23 | 1.2 | 602 |

Softness testing was completed on Examples 1-13. The data is shown in table 3 and plots of tensile vs. softness are shown graphically in FIG. 2 for both blended and layered sheets. As seen in FIG. 2, the cationic synthetic co-polymers of the present invention provide equivalent softness to the standard debonders known in the art but also provide for lower slough products. This benefit is seen independent of the particular sheet structure employed. Hence, as FIG. 3 shows, it is possible to make equivalently soft tissue products that advantageously have lower lint and slough by employing the cationic synthetic co-polymers of the present invention. Again, this effect is independent of the particular tissue sheet structure that may be employed.

TABLE 3

| Example | Additive | Amount % of Total Sheet Dry Fiber | Slough, mg | GMT | Softness |
|---|---|---|---|---|---|
| 1 | None | 0 | 1.8 | 717 | 7.7 |
| 2 | Prosoft TQ-1003 | 0.1% | 4.8 | 346 | 8.3 |
| 3 | Prosoft TQ-1003 | 0.2% | 7.6 | 232 | 8.6 |
| 4 | Invention | 0.1% | 2.0 | 496 | 8.1 |
| 5 | Invention | 0.2% | 1.3 | 433 | 8.2 |
| 6 | Invention | 0.4% | 1.2 | 441 | 8.2 |
| 7 | None | 0 | 2.3 | 753 | 8.1 |
| 8 | Prosoft TQ-1003 | 0.025% | 6.3 | 594 | 8.5 |
| 9 | Prosoft TQ-1003 | 0.05% | 5.0 | 544 | 8.4 |
| 10 | Invention | 0.1% | 2.2 | 627 | 8.4 |
| 11 | Invention | 0.2% | 3.0 | 660 | 8.4 |

TABLE 3-continued

| Example | Additive | Amount % of Total Sheet Dry Fiber | Slough, mg | GMT | Softness |
|---|---|---|---|---|---|
| 12 | Invention | 0.4% | 2.3 | 652 | 8.3 |
| 13 | Invention | 0.8% | 1.2 | 602 | 8.3 |

Examples 14-19 compare the use of an anionic hydrophobically modified acrylate polymer and the cationic synthetic co-polymers of the present invention in a 2-layer, 2-ply facial tissue product.

Example 14

Example 14 demonstrates the preparation of a 2-layered tissue basesheet. The 2-layered tissue basesheet was made in general accordance with the procedure outlined in Example 7 with the exception that a 2-layered tissue basesheet used in this example was formed consisting of a layer which contacted the surface of the Yankee dryer containing 65% of the total sheet weight of eucalyptus hardwood kraft pulp fibers and a felt (air side) layer containing 35% total sheet weight of LL-19 northern softwood kraft pulp fibers. The finished 2-layered tissue basesheet was then converted into a 2-layer, 2-ply facial tissue product with the dryer side layer of each ply facing outward.

Example 15

Example 15 demonstrates the topical application of cationic synthetic co-polymers of the present invention to a wet, 2-layered tissue basesheet prior to drying the 2-layered tissue basesheet. The 2-layered tissue basesheet used in this example was prepared in general accordance with Example 14. A 30% by weight aqueous dispersion of a cationic synthetic co-polymer containing 80 mole % n-butyl acrylate and 20 mole % of [2-(methacryloyloxy)ethyl] trimethyl ammonium chloride was diluted with water and sprayed onto the side of the tissue basesheet that is later brought into contact with the Yankee dryer. The 2-layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 0.5%. The finished 2-layered tissue basesheet was then converted into a 2-layer, 2-ply facial tissue product with the dryer side layer of each ply facing outward.

Example 16

Example 16 demonstrates the topical application of cationic synthetic co-polymers of the present invention to a wet, 2-layered tissue basesheet prior to drying the 2-layered tissue basesheet. The 2-layered tissue basesheet used in this example was prepared in general accordance with Example 14. A 30% by weight aqueous dispersion of a cationic synthetic co-polymer containing 80 mole % n-butyl acrylate and 20 mole % of [2-(methacryloyloxy)ethyl] trimethyl ammonium chloride was diluted with water and sprayed onto the side of the tissue basesheet that is later brought into contact with the Yankee dryer. The 2-layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersion. No changes were required to the creping adhesive package and no felt plugging or other process issues were encountered with application of the cationic synthetic co-polymer. The amount of cationic synthetic co-polymer to total tissue basesheet fiber on a dry weight basis was about 1.0%. The finished 2-layered tissue basesheet was then converted into a 2-layer, 2-ply facial tissue product with the dryer side layer of each ply facing outward.

Example 17

Example 17 demonstrates the topical application of a hydrophobically modified anionic co-polymer to a wet, 2-layered tissue basesheet prior to drying the 2-layered tissue basesheet. The 2-layered tissue basesheet used in this example was prepared in general accordance with Example 14. A 30% by weight aqueous dispersion of a hydrophobically modified anionic co-polymer containing 60 mole % acrylic acid; 24.5 mole % n-butylacrylate; 10.5 mole % 2-ethylhexylacrylate; and, 5 mole % AMPS wherein the AMPS was converted to the sodium salt was diluted with water and sprayed onto the side of the tissue basesheet that is later brought into contact with the Yankee dryer. The 2-layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted hydrophobically modified anionic co-polymer dispersion. Significant issues were encountered with crush and holes in the 2-layered tissue basesheet when using the anionic co-polymer. The amount of anionic co-polymer to total tissue basesheet fiber on a dry weight basis was about 0.15%. The finished 2-layered tissue basesheet was then converted into a 2-layer, 2-ply facial tissue product with the dryer side layer of each ply facing outward.

Example 18

Example 18 demonstrates the topical application of a hydrophobically modified anionic co-polymer to a wet, 2-layered tissue basesheet prior to drying the 2-layered tissue basesheet. The 2-layered tissue basesheet used in this example was prepared in general accordance with Example 14. A 30% by weight aqueous dispersion of a hydrophobically modified anionic co-polymer containing 60 mole % acrylic acid; 24.5 mole % n-butylacrylate; 10.5 mole % 2-ethylhexylacrylate; and, 5 mole % AMPS wherein the AMPS was converted to the sodium salt was diluted with water and sprayed onto the side of the tissue basesheet that is later brought into contact with the Yankee dryer. The 2-layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted hydrophobically modified anionic co-polymer dispersion. Significant issues were encountered with crush and holes in the 2-layered tissue basesheet when using the anionic co-polymer. The amount of anionic co-polymer to total tissue basesheet fiber on a dry weight basis was about 0.25%. The finished 2-layered tissue basesheet was then converted into a 2-layer, 2-ply facial tissue product with the dryer side layer of each ply facing outward.

Example 19

Example 19 demonstrates the topical application of a hydrophobically modified anionic co-polymer to a wet, 2-layered tissue basesheet prior to drying the 2-layered tissue basesheet. The 2-layered tissue basesheet used in this example was prepared in general accordance with Example 14. A 30% by weight aqueous dispersion of a hydrophobically modified anionic co-polymer containing 60 mole % acrylic acid; 24.5 mole % n-butylacrylate; 10.5 mole % 2-ethylhexylacrylate; and, 5 mole % AMPS wherein the AMPS was converted to the sodium salt was diluted with water and sprayed onto the side of the tissue basesheet that is later brought into contact with the Yankee dryer. The 2-layered tissue basesheet had a consistency, at this point, of between about 10% and about 20%. The aqueous dispersion was sprayed through two nozzles (commercially available under the designation 650017 from Spraying Systems Co., Wheaton, Ill.) at about 60 psi for a total addition rate of about 180 mL/min. Addition levels were controlled by adjusting the concentration of the diluted hydrophobically modified anionic co-polymer dispersion. Significant issues were encountered with crush and holes in the 2-layered tissue basesheet when using the anionic co-polymer. The amount of anionic polymer to total sheet fiber on a dry weight basis was about 0.50%. Significant issues with felt plugging and crush were encountered such that it was not possible to transfer the sheet to the Yankee dryer and no product could be obtained.

Furthermore, as Table 4 shows, the anionic co-polymer used in Examples 17-19 did not reduce slough and tensile as did the cationic synthetic co-polymer used in Examples 15-16. The tensile reduction seen in Example 18 is most likely due to the large number of holes in the sheet and not representative of a debonding effect. The 2-layered tissue basesheet treated in accordance with Example 19 could not be transferred to the Yankee dryer and wound due to the extremely poor quality of the tissue basesheet.

TABLE 4

| Example | Additive | Amount % of Dry Fiber | Wet-out time, s | Slough, mg | GMT |
|---|---|---|---|---|---|
| 14 | None | 0 | 4 | 7.2 | 631 |
| 15 | Cationic, invention | 0.5% | 12 | 5.6 | 610 |
| 16 | Cationic, invention | 1.0% | 21 | 4.8 | 550 |
| 17 | Anionic | 0.15% | 5 | 11.6 | 661 |
| 18 | Anionic | 0.25% | 10 | 7.3 | 577 |
| 19 | Anionic | 0.50% | Could not make sheet | | |

Examples 20-28

Examples 20-28 demonstrate the applicability of the present invention using a number of different cationic synthetic co-polymers. Additionally, these examples demonstrate ability to use the cationic synthetic co-polymers of the present invention in conjunction with other cationic papermaking additives. In Examples 20-28, the layered tissue basesheets used were made in general accordance with Examples 7-13. A cationic glyoxylated polyacrylamide, available under the trade designation of Parez 631NC manufactured by Bayer, Inc., Suffolk, Va., was added to the LL-19 softwood kraft pulp fibers in the machine chest at a level of about 5 pounds of dry solids of the chemical per ton of dry LL-19 softwood kraft pulp fibers. A commercially available cationic polyamide epichlorohydrin wet strength resin, Kymene 6500 available from Hercules, Inc. was added to both the northern softwood kraft pulp fibers and the eucalyptus hardwood kraft pulp fibers in the machine chest at a level of about 4 pounds of dry solids of the chemical per ton of dry fiber. The cationic synthetic co-polymers were applied as aqueous dispersions via spraying through two nozzles (commercially available under the designation 650017 from Spraying Systems Co., Wheaton, Ill.) at about 60 psi for a total addition rate of about 180 mL/min. Addition levels were controlled by adjusting the concentration of the diluted cationic synthetic co-polymer dispersions. In each example, the layered tissue basesheets were converted into 2-ply facial tissue products with the dryer side layer of each ply facing outward as with all previous examples.

For Examples 21-23, a standard cationic oleylimidazoline debonder, available under the designation of Prosoft TQ-1003 manufactured by Hercules, Inc., was added to the northern softwood kraft pulp fibers going to the layer of the tissue basesheet in each example that is later brought into contact with the Yankee dryer. The debonder was added to the machine chest as about 1% aqueous emulsion and allowed to stir for about 5 minutes prior to forming the tissue basesheet for each example.

TABLE 5

| Chemical | Composition |
|---|---|
| I | 89.9 mole % Ethyl Acrylate, 0.1 mole % Methyl Methacrylate, 10 mole % [2-(methacryloyloxy)ethyl] trimethyl ammonium chloride |
| II | 89.9 mole % Ethyl Acrylate, 0.1 mole % Methyl Methacrylate, 10 mole % 2-[(acryloyloxy)ethyl]trimethylammonium chloride |
| III | 74.9 mole % Ethyl Acrylate, 0.1 mole % Methyl Methacrylate, 25 mole % 2-[(acryloyloxy)ethyl]trimethylammonium chloride |
| IV | 80 mole % Butyl Acrylate, 20% mole % [2-(methacryloyloxy)ethyl] trimethylammonium methosulfate |

Specific chemical compositions of the cationic synthetic co-polymers used in Examples 24-27 are shown in Table 5. The chemical compositions I-III were prepared via an emulsion polymerization process using a non-ionic surfactant. The chemical compositions I-III were delivered as between about 25% to about 35% solids aqueous emulsions. The chemical composition IV was prepared via a solvent displacement process and was delivered as a 30% solids aqueous dispersion containing no surfactants. The physical test results are shown in Table 6. Example 28 is a control sample used to determine impact of water spraying alone on the tissue basesheet. As Example 28 demonstrates, the effects seen in the tissue basesheet, and ultimately the facial tissue products made from the tissue basesheets, wherein the cationic synthetic co-polymers of the present invention was used, are related to application of the cationic synthetic co-polymer and not a function of the water.

TABLE 6

| Example | Additive | Amount % of Total Sheet Dry Fiber | Wet-out time, s | Slough, mg | GMT | Softness |
|---|---|---|---|---|---|---|
| 20 | None | 0 | 6 | 3.5 | 1160 | 6.9 |
| 21 | Prosoft TQ-1003 | 0.05% | 5 | 3.9 | 1026 | 7.2 |
| 22 | Prosoft TQ-1003 | 0.15% | 3 | 7.8 | 747 | 7.8 |
| 23 | Prosoft TQ-1003 | 0.20% | 3 | 6.8 | 635 | 8.0 |
| 24 | III | 0.40% | 10 | 2.0 | 1124 | 7.0 |
| 25 | II | 0.40% | 21 | 2.3 | 842 | 7.6 |
| 26 | I | 0.40% | 22 | 2.1 | 733 | 7.6 |
| 27 | IV | 0.20% | 23 | 2.3 | 772 | 7.4 |
| 28 | Water | | 7 | 4.1 | 1052 | 7.0 |

Figure 4:
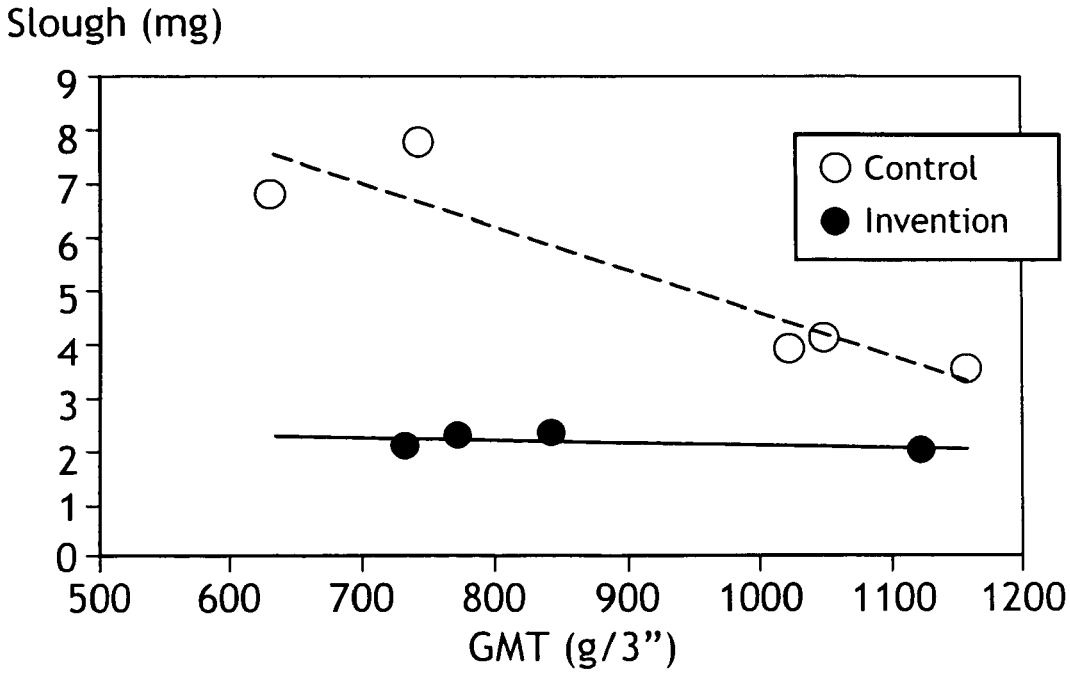
FIG. 4 is a graph comparing GMT and slough values for a topical application to a wet sheet of various synthetic co-polymers of the present invention and controls.
Figure 5:
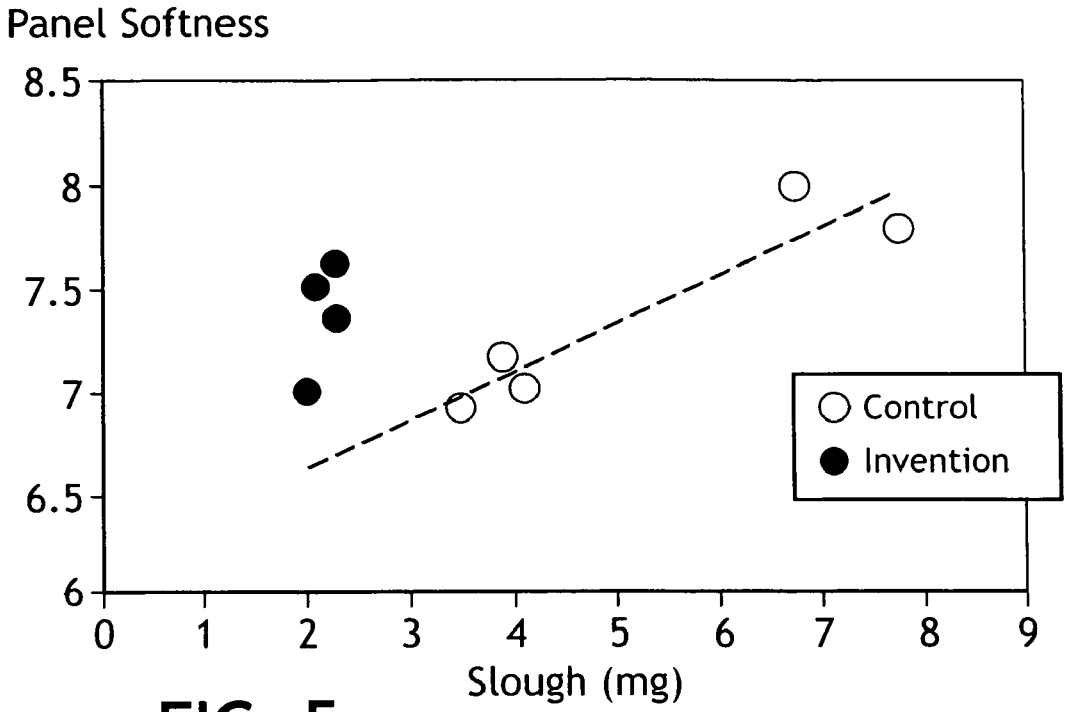
FIG. 5 is a graph comparing slough and softness values for a topical application to a wet sheet of various synthetic co-polymers of the present invention and controls.

The data is shown graphically in FIGS. 4 and 5. As with the previous examples, the cationic synthetic co-polymers of the present invention show significantly less slough increase with decreased tensile than the standard oleylimidazoline debonder. FIG. 5 shows that the facial tissue products made using the cationic synthetic co-polymers of the present invention display lower slough at a given level of softness.

Examples 29-34

In Examples 29-34, all examples used a layered basesheet made in general accordance with Examples 7-13 with the exception that no refining was done to the eucalyptus hardwood kraft pulp fibers. A cationic glyoxylated polyacrylamide, available under the designation of Parez 631NC manufactured by Bayer, Inc., was added to the LL-19 softwood kraft pulp fibers in the machine chest at a level of about 10 pounds of dry solids of the chemical per ton of the dry LL-19 softwood kraft pulp fibers. A cationic polyamide epichlorohydrin wet strength resin, available under the designation of Kymene 6500 manufactured by Hercules, Inc. was added to both the northern softwood kraft pulp fibers and the eucalyptus hardwood kraft pulp fibers in the machine chest at a level of about 4 pounds of dry solids of the chemical per ton of dry kraft pulp fiber. The cationic acrylate polymers and debonders were added to the Eucalyptus hardwood kraft fibers in the machine chest going to the layer of the tissue basesheets that is later brought into contact with the Yankee dryer. Specific chemical compositions of the cationic synthetic co-polymers used in Examples 31-34 are given in Table 7.

TABLE 7

| Chemical | Composition |
|---|---|
| V | 95 mole % methyl acrylate, 5 mole % [2-(acryloyloxy)ethyl] trimethyl ammonium chloride |
| VI | 80 mole % N-butyl acrylate, 20 mole % [2-(methacryloyloxy)ethyl] trimethyl ammonium chloride |

Figure 6:
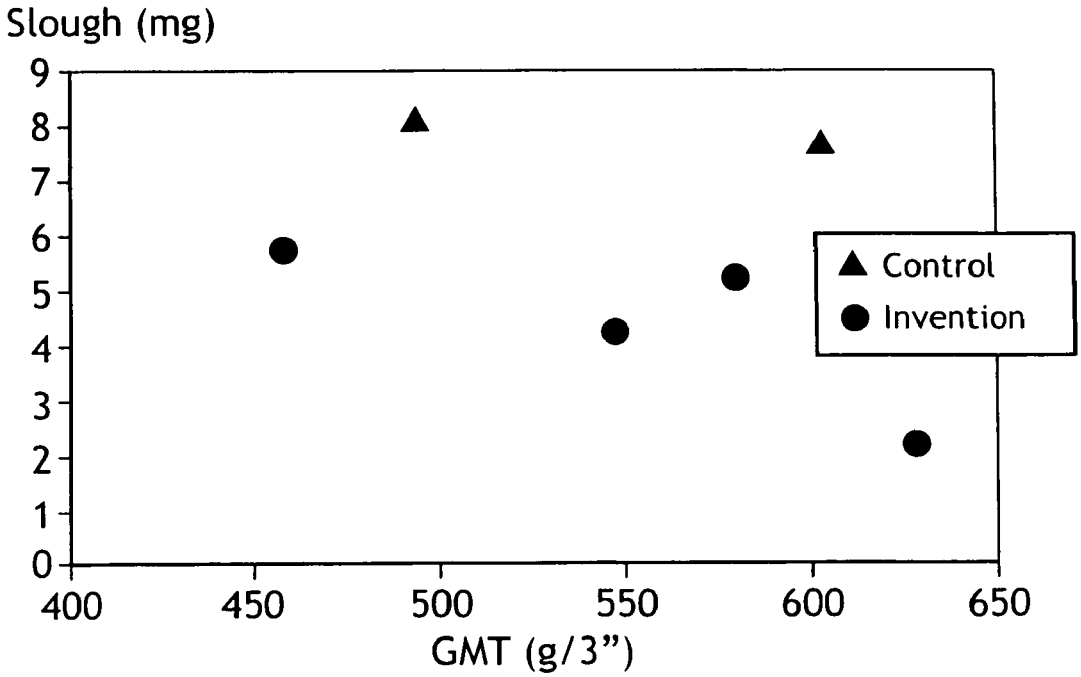
FIG. 6 is a graph comparing GMT and slough values for bulk wet end application of various synthetic co-polymers of the present invention and controls.
Figure 7:
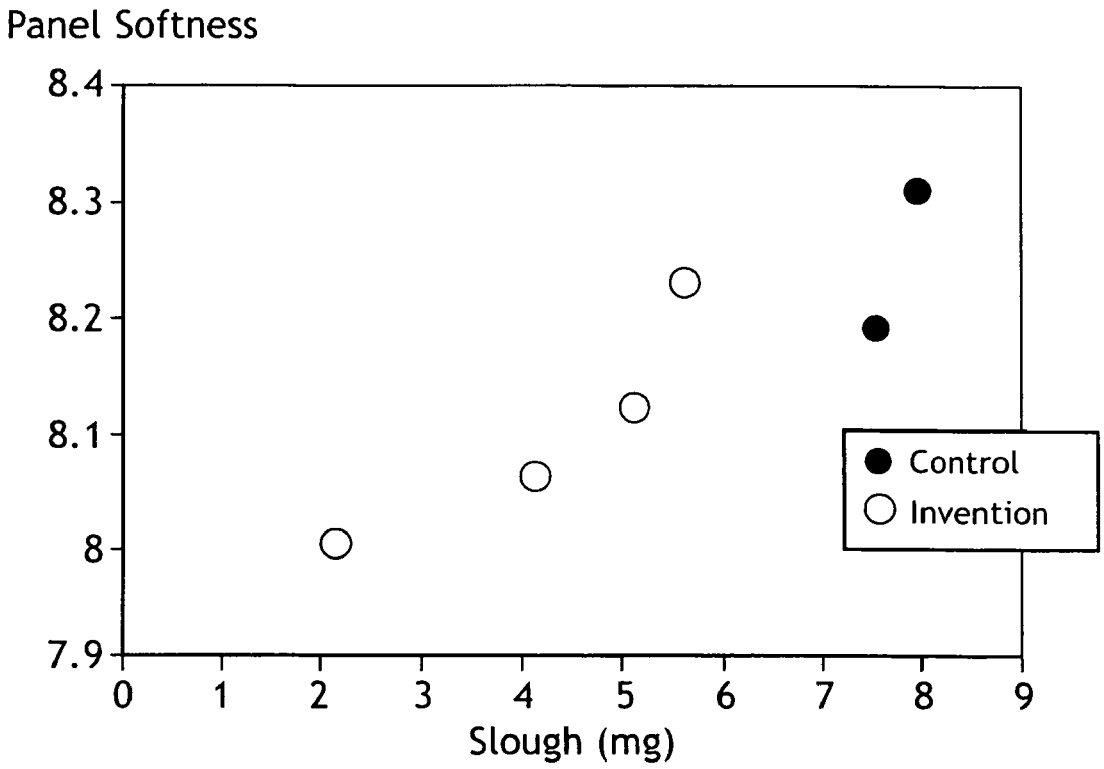
FIG. 7 is a graph comparing slough and softness values for bulk wet end application of various synthetic co-polymers of the present invention and controls.

The slough, tensile, and softness results are shown in Table 8 and graphically presented in FIGS. 6 and 7. Relative to the control debonders, the cationic synthetic co-polymers of the present invention show significantly less slough formation. As with the other examples, tissue basesheets made using the cationic synthetic co-polymers of the present invention show less slough generation at a given tensile than the standard debonders.

TABLE 8

| Example | Additive | Weight % of Dry Fiber in Dryer Layer | Wet-out time, s | Slough, mg | GMT | Softness |
|---|---|---|---|---|---|---|
| 29 | Prosoft TQ-1003 | 0.10% | 2.9 | 7.6 | 605 | 8.2 |
| 30 | Prosoft TQ-1003 | 0.15% | 2.8 | 8.1 | 495 | 8.3 |
| 31 | V | 0.25% | 22 | 2.2 | 629 | 8.0 |
| 32 | V | 0.50% | 50.6 | 4.1 | 548 | 8.1 |
| 33 | VI | 0.25% | 38.4 | 5.1 | 581 | 8.1 |
| 34 | VI | 0.50% | 103.9 | 5.7 | 459 | 8.3 |

The results show that it is possible to reduce slough at equivalent or lower GMT by applying the cationic synthetic co-polymers of the present invention to a fiber slurry prior to formation of the tissue sheet.

We claim:

1. A method of making a soft, low lint tissue sheet, comprising:

(a) forming an aqueous suspension comprising papermaking fibers;

(b) depositing the aqueous suspension of papermaking fibers onto a forming fabric thereby forming a wet tissue sheet;

(c) dewatering the wet tissue sheet thereby forming a dewatered tissue sheet; and, (d) applying a synthetic co-polymer to the papermaking fibers in an amount from about 0.02 to about 5 weight percent by weight of dried papermaking fibers, said papermaking fibers having a consistency from about 0.2% to about 50%, the synthetic co-polymer having the general structure:

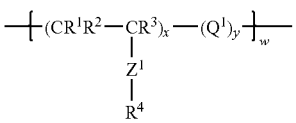

wherein:

$R^1$, $R^2$, $R^3$ are independently selected from a group consisting of: H; $C_{1-4}$ alkyl radicals; and, mixtures thereof;

$R^4$ is selected from a group consisting of $C_1$-$C_8$ alkyl radicals and mixtures thereof;

$Z^1$ is selected from a group consisting of: —O—; —COO—; —OOC—; —CONH—; —NHCO—; and mixtures thereof; and, $Q^1$ is a functional group containing at least a cationic quaternary ammonium radical, wherein w, x, y ≧1 and the mole ratio of x to (x+y) is about 0.5 or greater; and (e) drying the dewatered tissue sheet, thereby forming a dried treated tissue sheet having reduced geometric mean tensile strength as compared to an untreated tissue sheet and reduced slough as compared to a tissue sheet treated with the same amount of a commercially-available cationic oleylimidazoline debonder, wherein the amount of slough is from about 1.2 to about 3.0 milligrams.

2. The method of claim 1, wherein the synthetic co-polymer is applied to the wet tissue sheet having a consistency from about 10 percent to about 80 percent.

3. The method of claim 1, wherein the synthetic co-polymer is applied to the wet tissue sheet having a consistency from about 10 percent to about 50 percent.

4. The method of claim 1, wherein $R^1$ is H, $R^2$ is H, $R^3$ is H or —$CH_3$, and $R^4$ is selected from the group consisting of: methyl radicals; ethyl radicals; propyl radicals; butyl radicals; and, mixtures thereof.

5. The method of claim 1, wherein $Q^1$ of the synthetic co-polymer is derived from monomers selected from the group consisting of: [2-(methacryloyloxy)ethyl] trimethylammonium methosulfate; [2-(methacryloyloxy)ethyl] trimethylammonium ethosulfate; dimethyldiallyl ammonium chloride; 3-acryloamido-3-methyl butyl trimethyl ammonium chloride; vinyl benzyl trimethyl ammonium chloride; 2-[(acryloyloxy)ethyl]trimethylammonium chloride; [2-(methacryloyloxy)ethyl] trimethylammonium chloride; and, mixtures thereof.

6. The method of claim 1, wherein the mole ratio of x to (x+y) of the synthetic co-polymer is about 0.75 or greater.

7. The method of claim 1, wherein the mole ratio of x to (x+y) of the synthetic co-polymer is about 0.90 or greater.

8. The method of claim 1, wherein the synthetic co-polymer has an average molecular weight between about 10,000 to about 5,000,000.

9. The method of claim 1, wherein the synthetic co-polymer is water soluble or water dispersible.

10. The method of claim 1, wherein the dried tissue sheet has a Wet Out Time of about 180 seconds or less.

11. The method of claim 1, wherein the dried tissue sheet has a basis weight of about 5 to about 150 g/$m^2$ and a bulk of about 2 $cm^3$/g or greater.

12. The method of claim 10, wherein the dried tissue sheet has a bulk of about 4 $cm^3$/g or greater.

13. A method of making a soft, low lint tissue sheet, comprising:

(a) forming an aqueous suspension comprising papermaking fibers;

(b) depositing the aqueous suspension of papermaking fibers onto a forming fabric thereby forming a wet tissue sheet;

(c) dewatering the wet tissue sheet thereby forming a dewatered tissue sheet;

(d) applying a synthetic co-polymer to the papermaking fibers in an amount from about 0.02 to about 5 weight percent by weight of dried papermaking fibers, said papermaking fibers having a consistency from about 0.1% to about 50%, the synthetic co-polymer having the general structure:

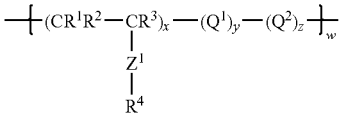

wherein:

w, x, y ≧1;

the mole ratio of (x+z) to (x+y+z) is greater than 0.5 and the mole ratio of z to (x+z) is from about 0 to about 0.8;

$R^1$, $R^2$, $R^3$ are independently selected from a group consisting of: H; $C_{1-4}$ alkyl radicals; and, mixtures thereof;

$R^4$ is selected from a group consisting of $C_1$ - $C_8$ alkyl radicals and mixtures thereof;

$Z^1$ is selected from a group consisting of: —O—; —COO—; —OOC—; —CONH—; —NHCO—; and mixtures thereof;

$Q^1$ is a functional group containing at least a cationic quaternary ammonium radical; and, $Q^2$ is derived from monomers selected from the group of: hydroxyalkyl acrylates;

hydroxyalkyl methacrylates; hydroxyethyl acrylate; polyalkoxyl acrylates; polyalkoxyl methacrylates; diacetone acrylamide; N-vinylpyrrolidinone; N-vinylformamide; and mixtures thereof; and (e) drying the dewatered tissue sheet, thereby forming a dried treated tissue sheet having reduced geometric mean tensile strength as compared to an untreated tissue sheet and reduced slough as compared to a tissue sheet treated with the same amount of a commercially-available cationic oleylimidazoline debonder, wherein the amount of slough is from about 1.2 to about 3.0 milligrams.

14. The method of claim 13, wherein the synthetic co-polymer is applied to the wet tissue sheet having a consistency from about 10 percent to about 80 percent.

15. The method of claim 13, wherein the synthetic co-polymer is applied to the wet tissue sheet having a consistency from about 10 percent to about 50 percent.

16. The method of claim 13 wherein the hydroxyalkyl methacrylate is a hydroxyethyl methacrylate.

17. The method of claim 13, wherein the polyalkoxyl acrylate is a polyethyleneglycol acrylate.

18. The method of claim 13, wherein the polyalkoxyl methacrylate is a polyethyleneglycol methacrylate.

19. The method of claim 13, wherein the mole ratio of (x+z) to (x+y+z) of the synthetic co-polymer is about 0.75 or greater.

20. The method of claim 13, wherein the mole ratio of (x+z) to (x+y+z) of the synthetic co-polymer is about 0.90 or greater.

21. The method of claim 13, wherein the mole ratio of z to (x+z) of the synthetic co-polymer is from about 0 to about 0.4.

22. The method of claim 13, wherein the mole ratio of z to (x+z) of the synthetic co-polymer is from about 0 to about 0.2.

23. The method of claim 13, wherein the synthetic co-polymer has an average molecular weight between about 10,000 to about 5,000,000.

24. The method of claim 13, wherein the synthetic co-polymer is water soluble or water dispersible.

25. The method of claim 24, wherein the dried tissue sheet has a Wet Out Time of about 180 seconds or less.

26. The method of claim 13, wherein the dried tissue sheet has a basis weight of about 5 to about 100 g/m$^2$, and a bulk of about 2 cm$^3$/g or higher.

27. The method of claim 26, wherein the dried tissue sheet has a bulk of about 4 cm$^3$/g or greater.

* * * * *

UNITED STATES PATENT AND TRADEMARK OFFICE

CERTIFICATE OF CORRECTION

PATENT NO. : 7,794,565 B2
APPLICATION NO. : 12/080683
DATED : September 14, 2010
INVENTOR(S) : Thomas G. Shannon et al.

It is certified that error appears in the above-identified patent and that said Letters Patent is hereby corrected as shown below:

Claim 25, Col. 34, line 28, is amended to read:

25. The method of claim 13, wherein the dried tissue sheet has a Wet Out Time of about 180 seconds or less.

Signed and Sealed this
Twenty-third Day of August, 2011

David J. Kappos

David J. Kappos
*Director of the United States Patent and Trademark Office*